US012059044B2

(12) United States Patent
Shams

(10) Patent No.: US 12,059,044 B2
(45) Date of Patent: Aug. 13, 2024

(54) BODY SCULPTING GARMENT

(71) Applicant: Leila Shams, Los Angeles, CA (US)

(72) Inventor: Leila Shams, Los Angeles, CA (US)

(73) Assignee: TA3 INC., Los Angeles, CA (US)

( * ) Notice: Subject to any disclaimer, the term of this patent is extended or adjusted under 35 U.S.C. 154(b) by 0 days.

(21) Appl. No.: 17/736,969

(22) Filed: May 4, 2022

(65) Prior Publication Data

US 2022/0256955 A1 Aug. 18, 2022

Related U.S. Application Data

(63) Continuation-in-part of application No. 16/693,210, filed on Nov. 22, 2019.

(51) Int. Cl.

| | |
|---|---|
| ***A41D 27/00*** | (2006.01) |
| ***A41D 1/14*** | (2006.01) |
| ***A41D 7/00*** | (2006.01) |

(52) U.S. Cl.

CPC ..... *A41D 27/00* (2013.01); *A41D 1/14* (2013.01); *A41D 7/00* (2013.01); *A41D 2400/38* (2013.01)

(58) Field of Classification Search

CPC ..... A41D 7/00; A41D 7/001; A41D 7/005; A41D 2400/38; A41D 2400/00; A41D 31/185; A41D 31/18; A41D 31/00; A41D 27/02; A41D 31/02; A41D 31/04; A41B 9/00; A41C 1/00

See application file for complete search history.

(56) References Cited

U.S. PATENT DOCUMENTS

| | | | | | |
|---|---|---|---|---|---|
| 1,312,459 | A * | 8/1919 | Strocker | A41C 1/06 | 450/13 |
| 2,583,865 | A * | 1/1952 | McIlhinney | A41D 7/00 | 450/8 |
| 4,654,894 | A * | 4/1987 | Kudo | A41D 7/00 | 2/67 |
| 4,916,755 | A * | 4/1990 | Feigenbaum | A41D 7/00 | 450/40 |
| 5,083,316 | A * | 1/1992 | Kuehner | A41D 7/00 | D2/737 |
| 5,996,120 | A * | 12/1999 | Balit | A41D 13/0017 | 2/243.1 |
| 9,717,289 | B1 * | 8/2017 | Fooden | A41D 7/00 | |

(Continued)

*Primary Examiner* — Khoa D Huynh
*Assistant Examiner* — Uyen T Nguyen
(74) *Attorney, Agent, or Firm* — Osha Bergman Watanabe & Burton LLP

(57) ABSTRACT

A garment for shaping a form of its wearer includes a front panel and a back panel coupled to one another at first and second seams. The front panel comprises self-lining material in each of a bottom portion and a pectoral portion and compression layer material in a torso portion of the front panel. The back panel includes a first arcuate portion of compression layer material along the first seam and a second arcuate portion of compression layer material along the second seam. Lining material extends from an upper portion of the back panel to a bottom portion of the back panel and is coupled to the two arcuate portions such that the two arcuate portions are separated by the lining material. The compression layer material has a higher elastic modulus than a respective elastic modulus of the lining material.

19 Claims, 21 Drawing Sheets

(56) References Cited

U.S. PATENT DOCUMENTS

| | | | | |
|---|---|---|---|---|
| 2006/0166600 | A1* | 7/2006 | Ravoiu | A41C 1/06 450/7 |
| 2009/0038047 | A1* | 2/2009 | Di Lorenzo | A41D 7/005 2/67 |
| 2011/0138524 | A1* | 6/2011 | Alfstad | A41D 13/015 2/24 |
| 2011/0225696 | A1* | 9/2011 | Di Lorenzo | A41D 7/00 2/67 |
| 2012/0129425 | A1* | 5/2012 | Bevans | A41D 1/06 450/11 |
| 2012/0266347 | A1* | 10/2012 | DiLorenzo | A41D 7/00 450/95 |
| 2014/0273734 | A1* | 9/2014 | Gordon | A41C 1/06 450/7 |
| 2015/0208734 | A1* | 7/2015 | Callahan | A41D 1/22 450/30 |
| 2016/0150832 | A1* | 6/2016 | Solano | A41B 11/14 450/95 |
| 2019/0059465 | A1* | 2/2019 | Zimmer | A41D 7/00 |
| 2021/0186123 | A1* | 6/2021 | Solano | A41B 11/14 |
| 2022/0151308 | A1* | 5/2022 | Penfield | A41C 1/003 |

* cited by examiner

BODY SCULPTING GARMENT

RELATED APPLICATIONS

This application is a continuation-in-part application to U.S. Non-provisional application Ser. No. 16/693,210 entitled "Body Sculpting Garment" filed Nov. 22, 2019, which is incorporated herein by reference in its entirety.

FIELD

This application relates to a body sculpting garment.

BACKGROUND

Users that wear garments, such as swimsuits or dresses, may want to have body portions be compressed to have an "hourglass" shape. Specifically, wearers desire a curvy look where the bust is lifted, the front and back waist is reduced, and the stomach is flattened but the hips and buttocks are not compressed. There are swimsuits that feature a compression lining, but the lining may lack flexibility and makes the swimsuit tight. These versions of slimming swimsuits have used a sewn or bonded lining that is tighter and/or less stretchy than the outer fabric portion to smooth the body. This also makes it more difficult for users to put on the swimsuit and to take off the swimsuit. Also, the swimsuit with this compression lining produces undesirable bulging at the leg opening. Further, the lining and/or bonding only smooths the stomach, it does not offer targeted compression to the entire waistline.

Garments such as swimsuits, lingerie, tops, and dresses may benefit from improvements.

SUMMARY OF INVENTION

In one aspect of the present disclosure, there is a garment, comprising: a front panel having an outer surface and an inner surface; a back panel having an outer surface and an inner surface; wherein the back panel is coupled to the front panel at first and second seams such that the respective inner surfaces face each other. The front panel outer surface comprises a front outer fabric layer; wherein the front panel inner surface comprises lining material in each of a bottom portion and a pectoral portion of the front panel inner surface and compression layer material in a torso portion of the front panel inner surface coupled to the lining material in each of the bottom and pectoral portions. The back panel outer surface comprises a back outer fabric layer. The back panel inner surface comprises a first arcuate portion of compression layer material along the first seam and a second arcuate portion of compression layer material along the second seam and lining material extending from an upper portion of the back panel surface to a bottom portion of the back panel surface, coupled to the two arcuate portions such that the two arcuate portions are separated by the lining material. The compression layer material has a higher elastic modulus than a respective elastic modulus of each of the outer fabric layer and the lining material.

In another aspect of the present disclosure, there is a garment, comprising: a front panel having an outer surface and an inner surface; and a back panel having an outer surface and an inner surface. The back panel is coupled to the front panel at first and second seams such that the respective inner surfaces face each other. The back panel inner surface comprises a first arcuate portion of compression layer material along the first seam and a second arcuate portion of compression layer material along the second seam and lining material extending from an upper portion of the back panel surface to a bottom portion of the back panel surface, coupled to the two arcuate portions such that the two arcuate portions are separated by the lining material. The compression layer material has a higher elastic modulus than a respective elastic modulus of the lining material.

Other aspects of the disclosed invention will become apparent from the following detailed description, the accompanying drawings, and the appended claims.

BRIEF DESCRIPTION OF THE DRAWINGS

FIGS. 14-1 and 14-2 are views of an outer facing surface and an inner facing surface, respectively, of a back panel component of the garment of FIG. 10;

FIGS. 16-1 and 16-2 are views of an outer facing surface and an inner facing surface, respectively, of a front panel component of the garment of FIG. 15;

FIGS. 17-1 and 17-2 are views of an outer facing surface and an inner facing surface, respectively, of a back panel component of the garment of FIG. 15

FIGS. 19-1 and 19-2 are views of an outer facing surface and an inner facing surface, respectively, of a front panel component of the garment of FIG. 18; and FIGS. 20-1 and 20-2 are views of an outer facing surface and an inner facing surface, respectively, of a back panel component of the garment of FIG. 18.

DETAILED DESCRIPTION

It will be readily understood that the components of the embodiments as generally described and illustrated in the figures herein, may be arranged and designed in a wide variety of different configurations in addition to the described example embodiments. Thus, the following more detailed description of the example embodiments, as represented in the figures, is not intended to limit the scope of the embodiments, as claimed, but is merely representative of example embodiments.

Furthermore, the described features, structures, or characteristics may be combined in any suitable manner in one or more embodiments. In the following description, numerous specific details are provided to give a thorough understanding of embodiments. One skilled in the relevant art will recognize, however, that the various embodiments can be practiced without one or more of the specific details, or with other methods, components, materials, etc. In other instances, well-known structures, materials, or operations are not shown or described in detail to avoid obfuscation. The following description is intended only by way of example, and simply illustrates certain example embodiments.

Figure 1A:
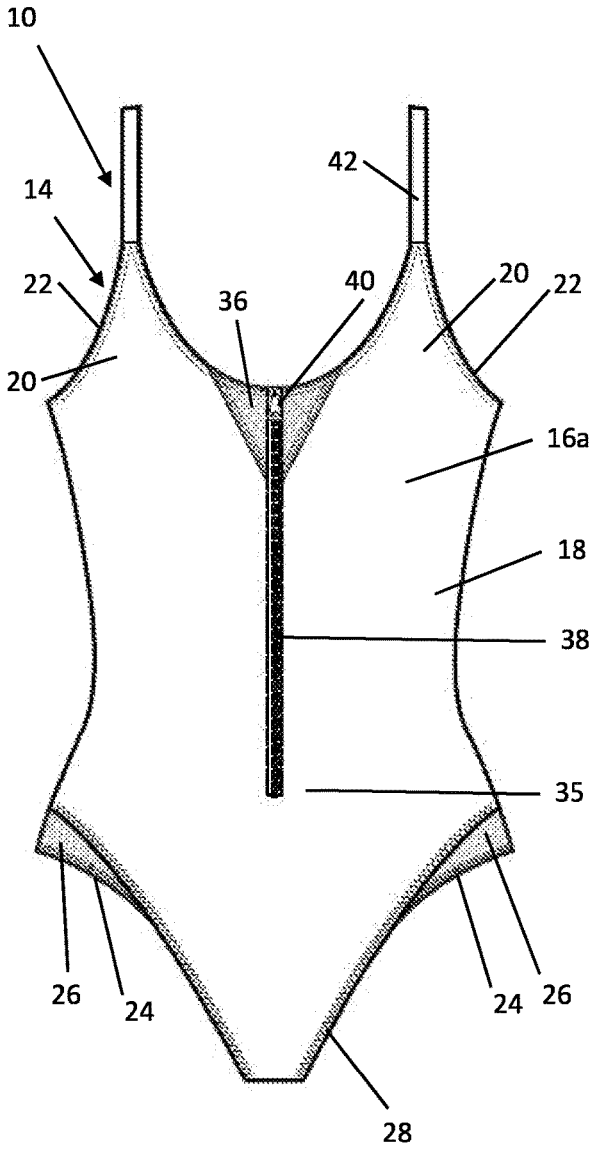
FIG. 1A is a front view of the outer fabric portion of a one-piece swimsuit according to a first embodiment of the invention.

Throughout the present description, the terms "upper", "lower", "top", "bottom", "left", "right", "front", "forward", "rear", and "rearward" shall define directions or orientations with respect to the swimsuit as illustrated in FIG. 1A. It will be understood that the spatially relative terms "upper", "lower", "top", "bottom", "left", "right", "front", "forward", "rear", and "rearward" are intended to encompass different orientations of the swimsuit in use or operation in addition to the orientation depicted in the figures. For example, if the swimsuit in the figures is turned over, elements described as "upper" elements or features would then be "lower" elements or features. Further, any reference to swimsuits applies also to dresses and the terms may be used interchangeably throughout the disclosure.

Figure 1B:
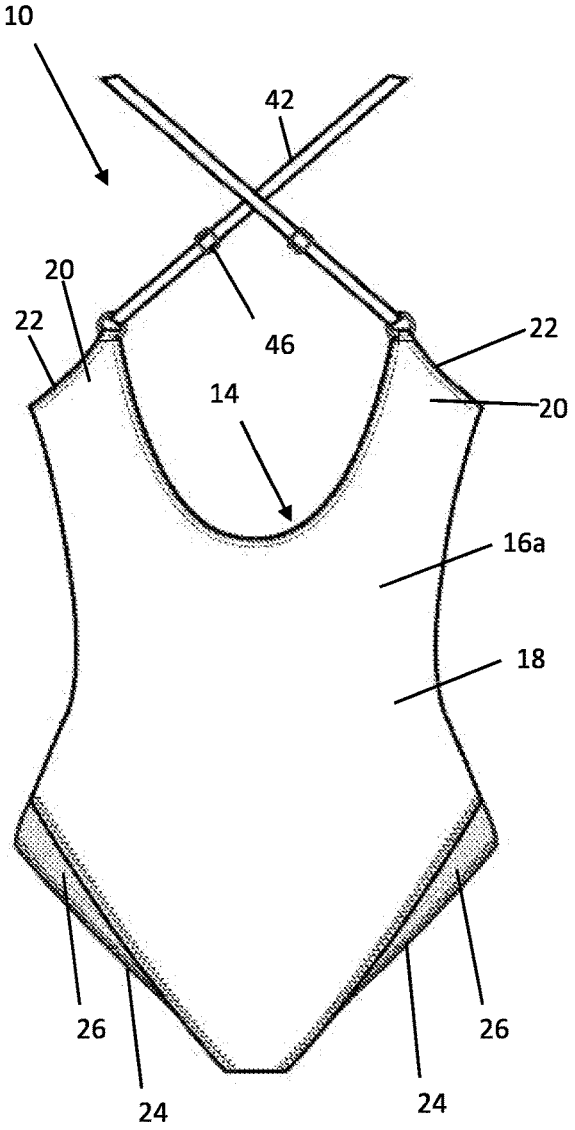
FIG. 1B is a rear view of the outer fabric portion of the one-piece swimsuit of FIG. 1A.

Referring to FIGS. 1A to 1D, a one-piece style swimsuit 10 is shown. It should be noted that other types of garments such as lingerie and dresses may incorporate the features of the present invention. The swimsuit includes an inner fabric portion 12 (FIGS. 1C and 1D) and an outer fabric portion 14 (FIGS. 1A and 1B).

As seen in FIGS. 1A and 1B, the outer fabric portion 14 of the suit comprises an outer fabric layer 16*a* that has an hourglass shaped lower portion 18 with upper shoulder portions 20 that define the arm openings 22. The leg openings 24 of the swimsuit are defined by end portions 26 of the outer fabric portion 14. Each end portion 26 comprises a single layer of self-starting mesh. The self-start mesh layer uses the natural edge of the fabric created during knitting and does not require a hem, binding or finishing at the free edge that may contribute to bulging and may unravel over time. The end portions 26 are attached by stitching, bonding or other suitable way to outer side ends 28 of the outer fabric layer 16*a* and self-lining layer 16*b*.

Figure 1C:
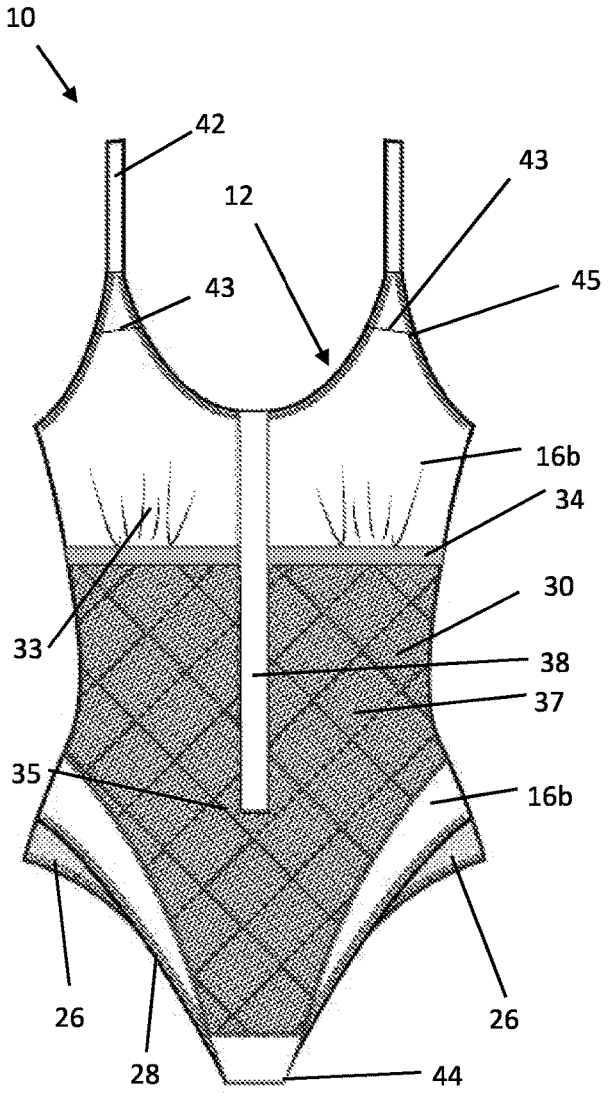
FIG. 1C is an inner view of the front of the one-piece swimsuit in either FIG. 1A or 2A.
Figure 1D:
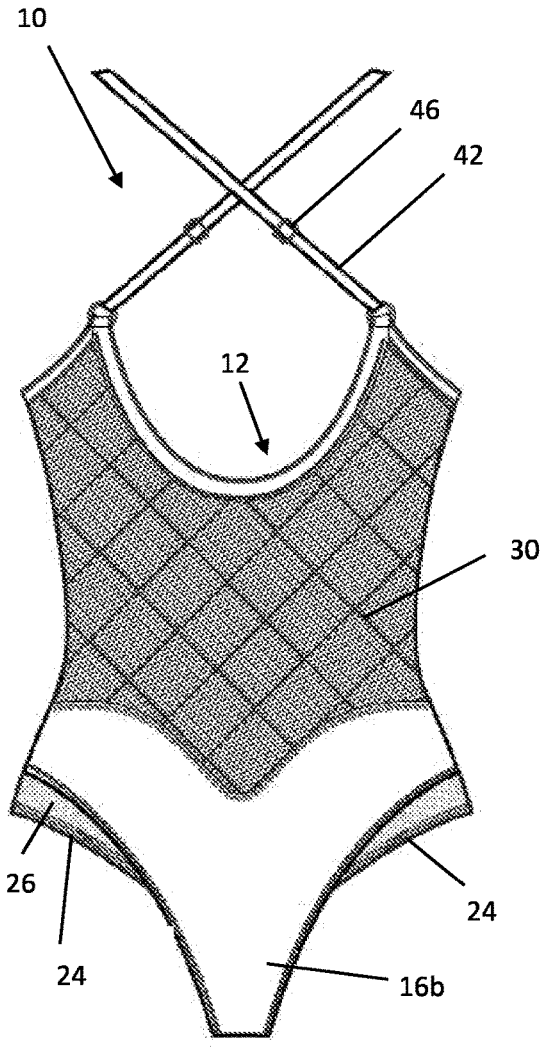
FIG. 1D is an inner view of the rear of the one-piece swimsuit in either FIG. 1B or 2B.
Figure 9:
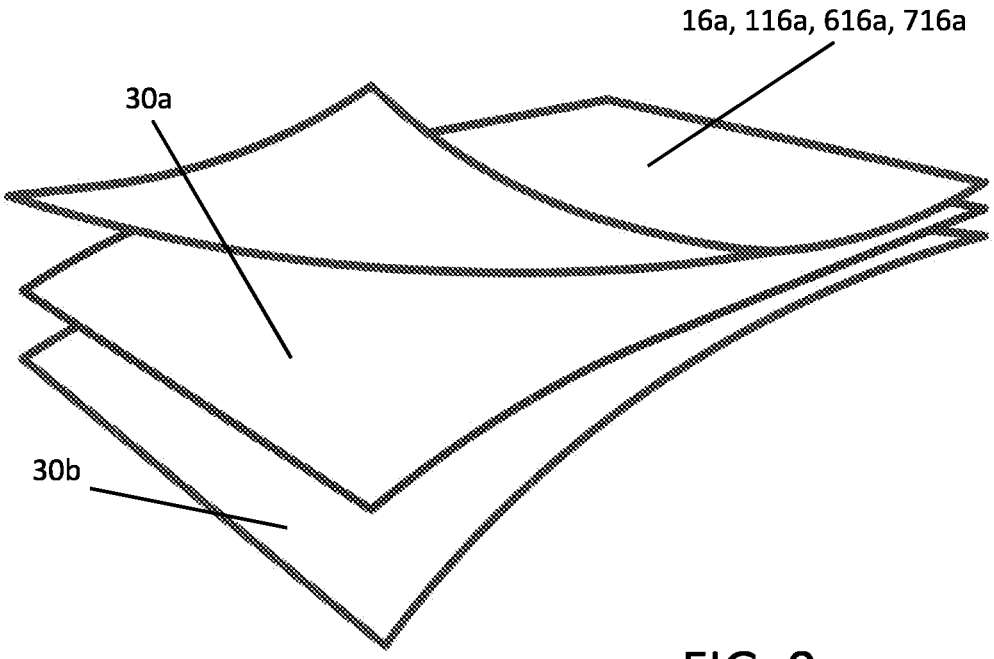
FIG. 9 is a schematic partial exploded view of a portion of the outer fabric layer positioned on the doubled layer power mesh fabric.

As seen in FIGS. 1C and 1D, the inner fabric portion 12 comprises a central compression fabric portion 30 and self-lining layer 16*b*. The central compression fabric portion 30 comprises outer and inner compression layers 30*a*, 30*b* (FIG. 9) that form a double layer of power mesh fabric. The outer and inner compression layers 30*a*, 30*b* of the power mesh fabric are attached to each other and to the outer fabric layer 16*a* with the outer fabric layer 16*a* positioned over the outer compression layer 30*a* as illustrated in FIG. 9. The outer fabric layer 16*a* is also attached to the self-lining layer 16*b* and covers the self-lining layer 16*b*. The central compression fabric portion 30 is substantially an hourglass shape and fits around the waist, belly, and lower back areas of a wearer but does not cover the bust, upper back, and buttock areas. The central compression fabric portion 30 extends from a bust covering portion 33 of the swimsuit at just below the wearer's bust to just above the respective bottom edges of the self-lining layer 16*b*. The central compression fabric portion 30 also extends laterally between the side ends 28 of the self-lining layer 16*b* near the leg openings 24.

The central compression fabric portion 30 comprises a waist covering portion 37 that is located inside the garment waist and reduces waist girth and stomach protrusion when the swimsuit is worn. The power mesh fabric of the central compression fabric portion 30 may be made of 100 percent nylon. The power mesh fabric acts as a heavy weight compression layer and is much less elastic than swimwear fabrics primarily composed of lycra or spandex or other elastic fiber type material. The central compression fabric portion 30 has a higher elastic modulus than that of the outer fabric portion 14, the self-lining layer 16*b* and the end portions 26. The power mesh fabric of the central compression fabric portion 30 provides superior hold and sculpting benefits due to its lack of stretch. It is also lightweight and does not add bulk to garments.

The swimsuit 10 further comprises an elastic support band 34 that is stitched, bonded, or otherwise attached to the upper end of the central compression fabric portion 30. The elastic support band 34 is located downwardly adjacent the bust covering portion 33 and fits under the bust area of the wearer to provide support to the bust area. A decorative mesh insert 36 (FIG. 1A) may be attached to the inner edges of the shoulder portions 20 of the outer fabric layer 16*a*. A central zipper placket 38 is stitched, bonded, or otherwise attached to the swimsuit 10 and extends from the center of the upper end of the mesh insert 36 down along the central compression fabric portion 30 and terminating at a hip portion 35 of the swimsuit 10 that is at a height that is approximately that of the hips of the wearer of the swimsuit when the swimsuit 10 is worn on the wearer.

The hip portion 35 is shaped to resemble the hips of the wearer of the swimsuit 10. The length of the zipper placket 38 may be two-thirds of the distance from the center of the upper end of the mesh insert 36 to the lower end of a crotch panel 44. The zipper placket 38 includes a zipper 40 (FIG. 1A) that removably binds opposing edges of an opening defined by the zipper placket 38 to open and close the opening. The zipper placket 38 enables or helps the wearer to easily put on and take off the swimsuit 10, since without the zipper placket 38 or other suitable alternative fastener for the opening, the inelastic power mesh fabric would make putting on and off the swimsuit 10 more difficult. Adjustable shoulder straps 42 are attached to the shoulder portions and extend over the shoulder when the swimsuit 10 is worn by the wearer. The shoulder straps 42 crisscross at the rear side (FIG. 1B) of the swimsuit 10. Removable pads may be inserted through openings 43 (FIG. 1C) of inner pockets 45 formed by the self-lining layer 16 at the shoulder portions 20.

At the leg opening 24 there is only the single mesh layer that defines the leg opening 24. This single layer of fabric at the leg opening 24 does not apply as much compression to the leg areas as the double layers thereby reducing bulges of the skin. The swimsuit 10 further includes the crotch panel 44 that is reinforced with a double layer of self-fabric to minimize the appearance of the vaginal lips when the swimsuit 10 is worn by the female wearer. The swimsuit 10 may expand by unzipping it to enable putting the swimsuit 10 on and off the wearer. The zipper placket 38 may be in the front or back and may be visible or invisible. The single mesh layer 26 at the leg opening maybe be sheer or opaque.

The swimsuit 10 is put on by using the zipper 40 to unzip the opening defined by the zipper placket 38, extending the legs through the leg openings 24, pulling the swimsuit 10 over the buttocks and thighs, extending the arms through the arm openings 22, placing the shoulder straps 42 over the shoulders, and then using the zipper 40 to zip up the opening defined by the zipper placket 38. The shoulder straps 42 can then be adjusted by strap adjusters 46 to be tighter or looser around the shoulder as desired. The swimsuit 10 can be worn for swimming, sunbathing, or as a bodysuit.

Because of the lack of elasticity resulting in poor stretching at the front and back waist due to the double layer power mesh construction, the shape of the waist area of the swimsuit mirrors the shape of the wearer. A wearer with a high waist to hip ratio (meaning waist is small compared to the hip, known as a "curvy" body type) will require a swimsuit with a similar, but smaller, ratio. A wearer with a low waist to hip ratio (known as a "straight" or "square" body type) will require a swimsuit with a less severe waist shape so the wearer does not experience unnatural and uncomfortable denting or buckling at the waist. A swimsuit with lacing (as disclosed in the following third, fourth, fifth, and sixth embodiments) will allow for the wearer to adjust the size of the waist. But a non-adjustable suit will require multiple fits (i.e., standard, curvy, straight, round (also known as an "apple" body type).

Figure 2A:
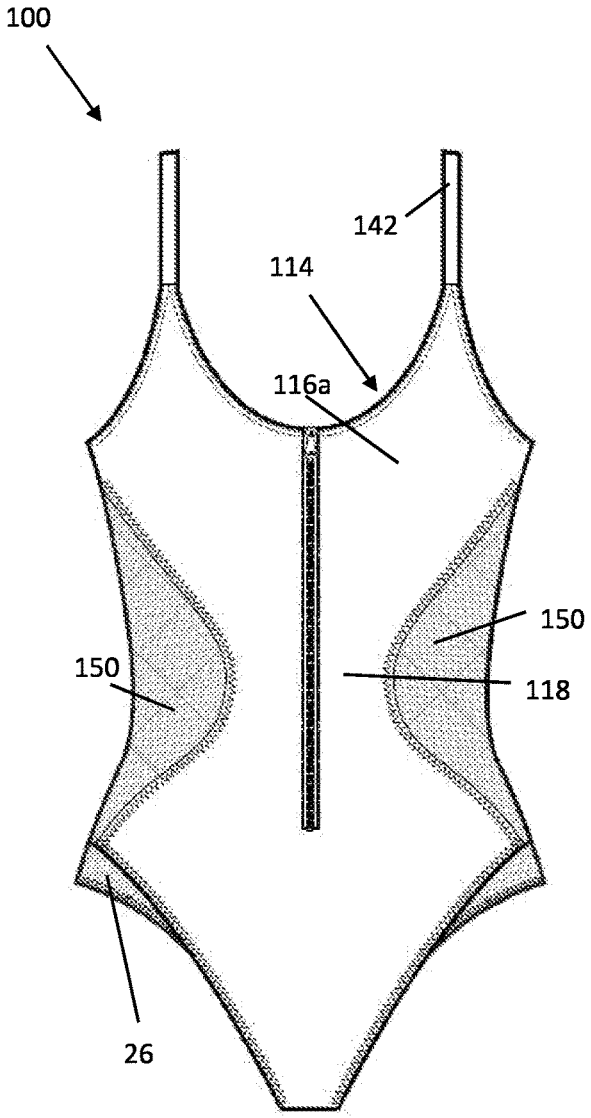
FIG. 2A is a front view of the outer fabric portion of a one-piece swimsuit according to a second embodiment of the invention.
Figure 2B:
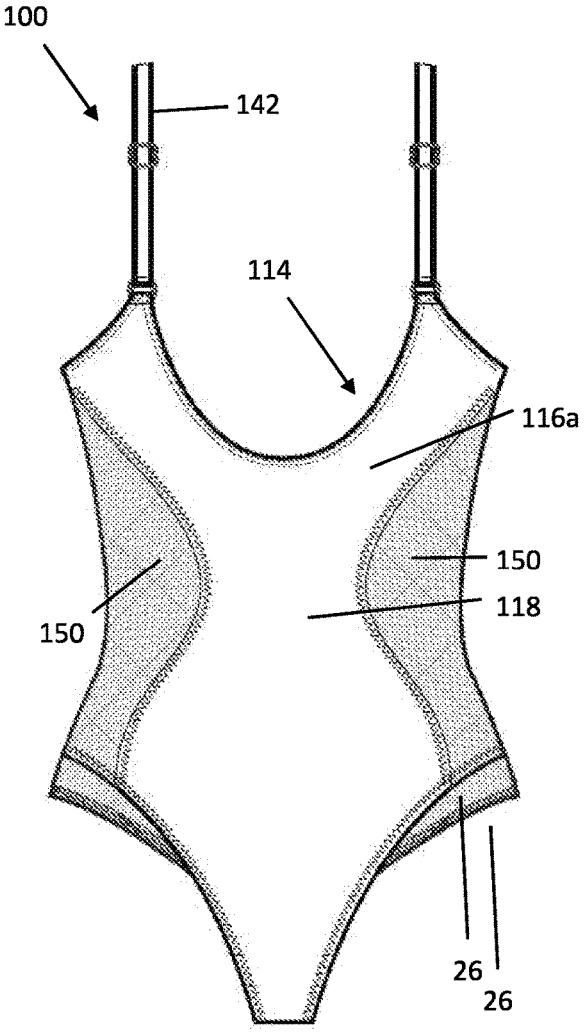
FIG. 2B is a rear view of the outer fabric portion of the one-piece swimsuit of FIG. 2A.
Figure 3A:
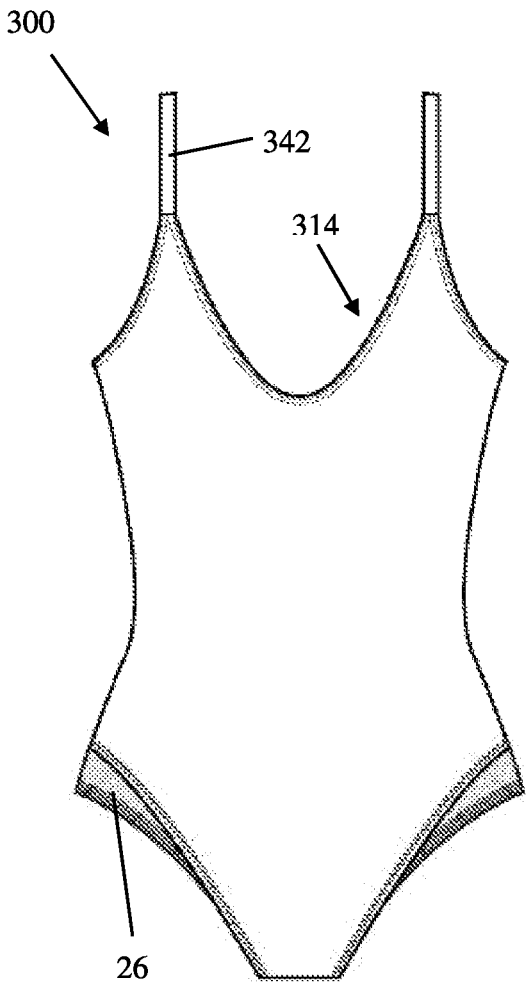
FIG. 3A is a front view of the outer fabric portion of a one-piece swimsuit according to a third embodiment of the invention.
Figure 3B:
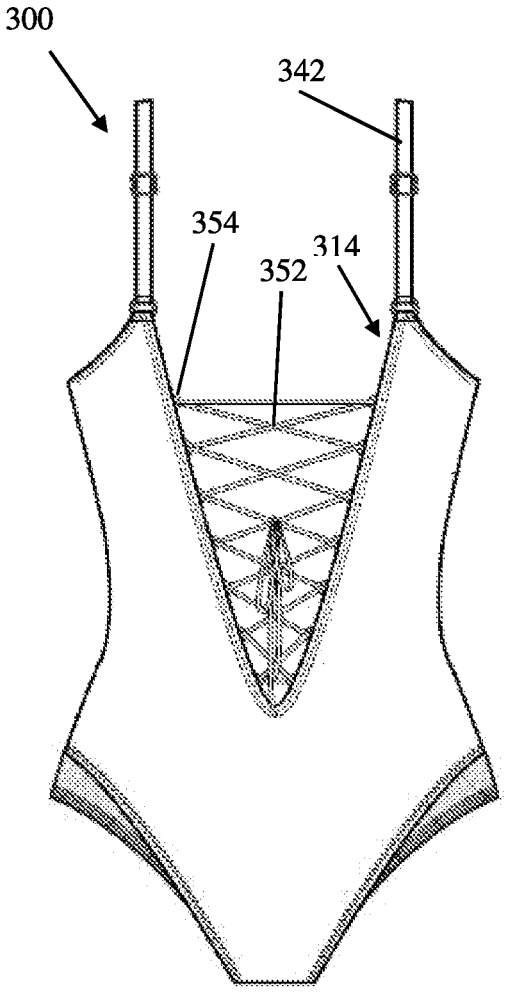
FIG. 3B is a rear view of the outer fabric portion of the one-piece swimsuit of FIG. 3A.
Figure 3C:
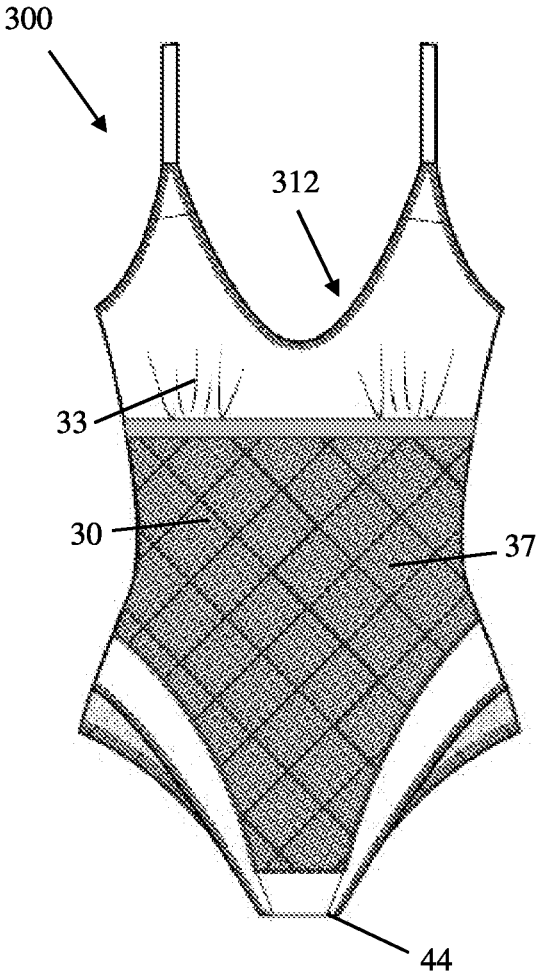
FIG. 3C is an inner view of the front of the one-piece swimsuit in FIG. 3A.
Figure 3D:
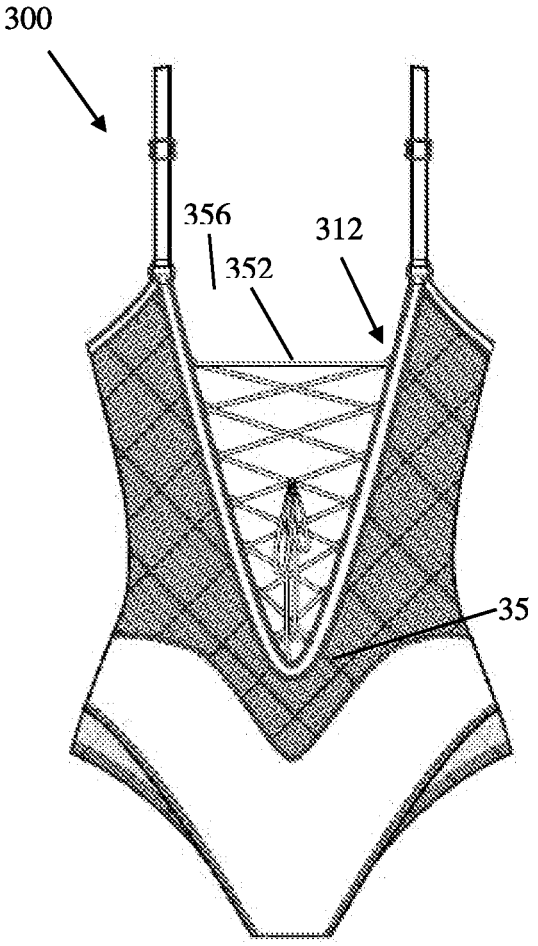
FIG. 3D is an inner view of the rear of the one-piece swimsuit in FIG. 3B.
Figure 4A:
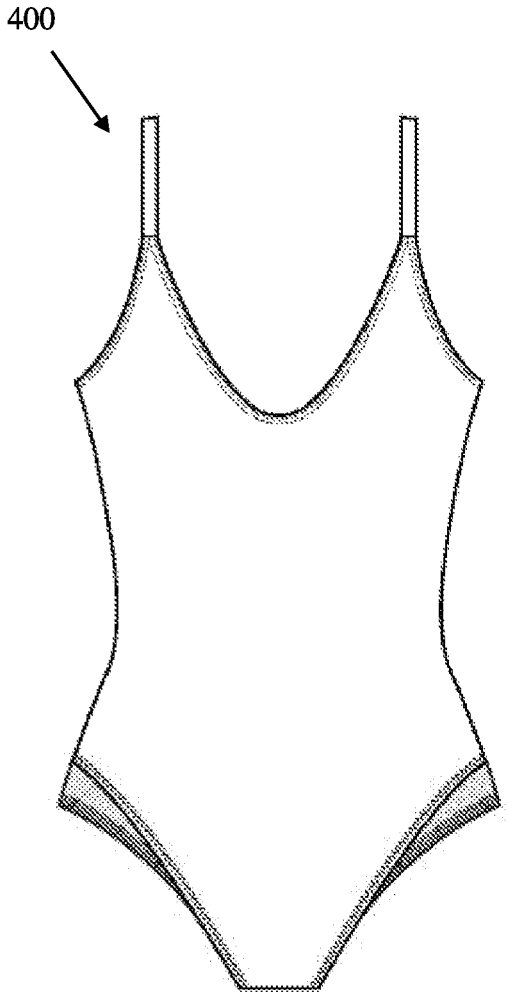
FIG. 4A is a front view of the outer fabric portion of a one-piece swimsuit according to a fourth embodiment of the invention.
Figure 4B:
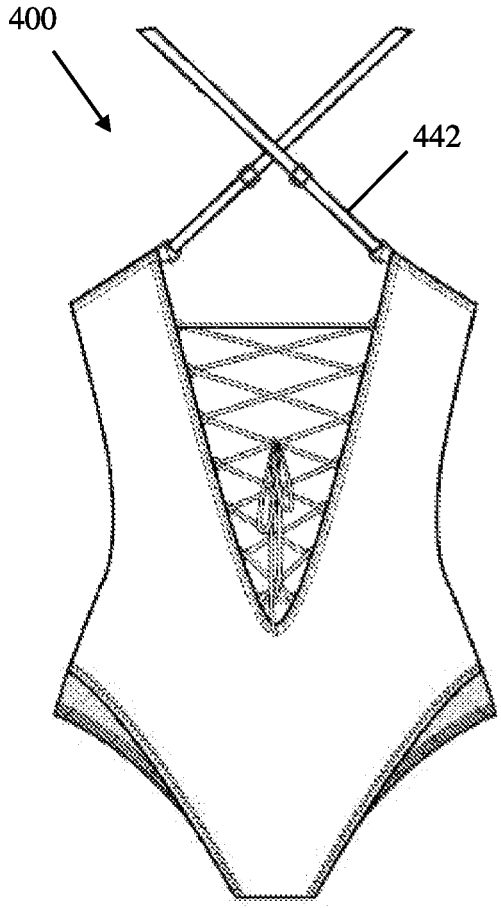
FIG. 4B is a rear view of the outer fabric portion of the one-piece swimsuit of FIG. 4A.
Figure 4C:
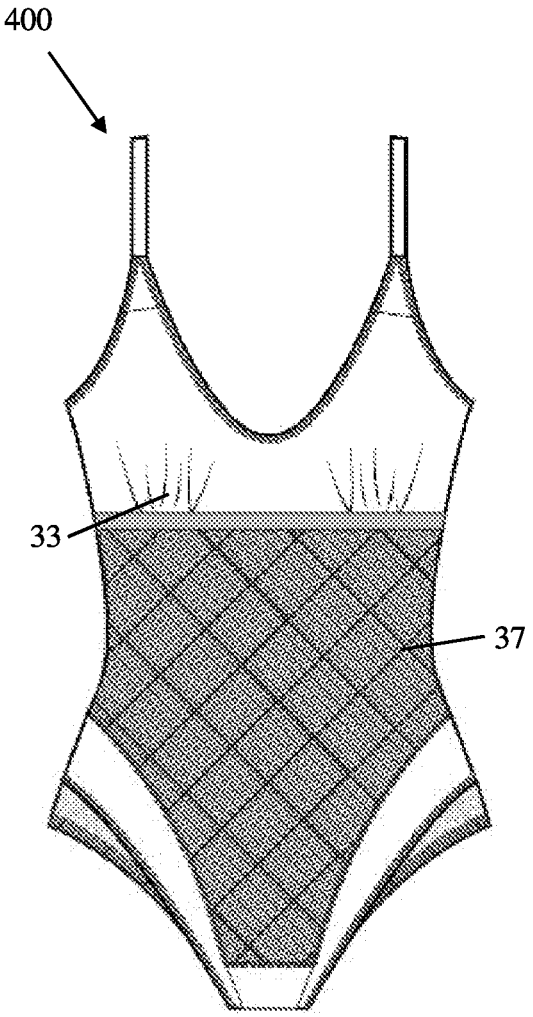
FIG. 4C is an inner view of the front of the one-piece swimsuit in FIG. 4A.
Figure 4D:
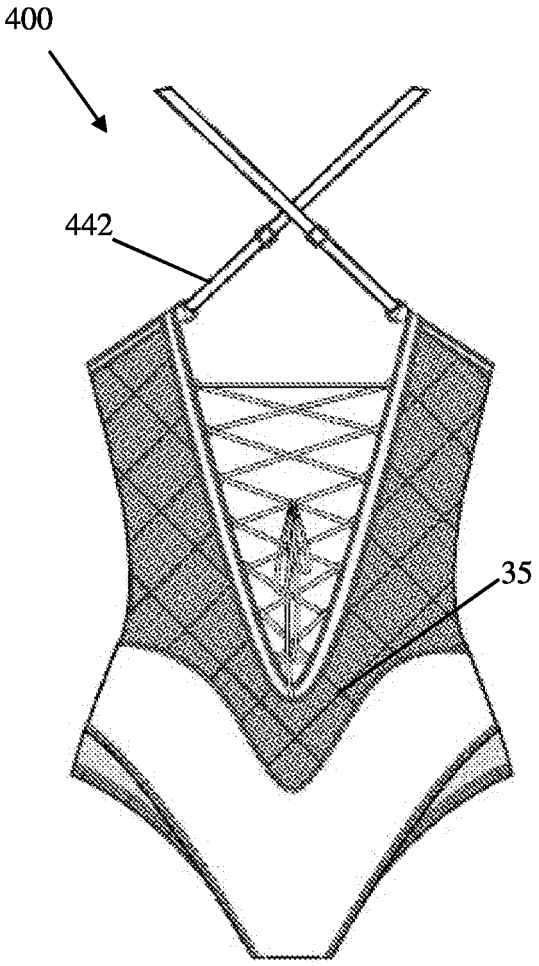
FIG. 4D is an inner view of the rear of the one-piece swimsuit in FIG. 4B.
Figure 5A:
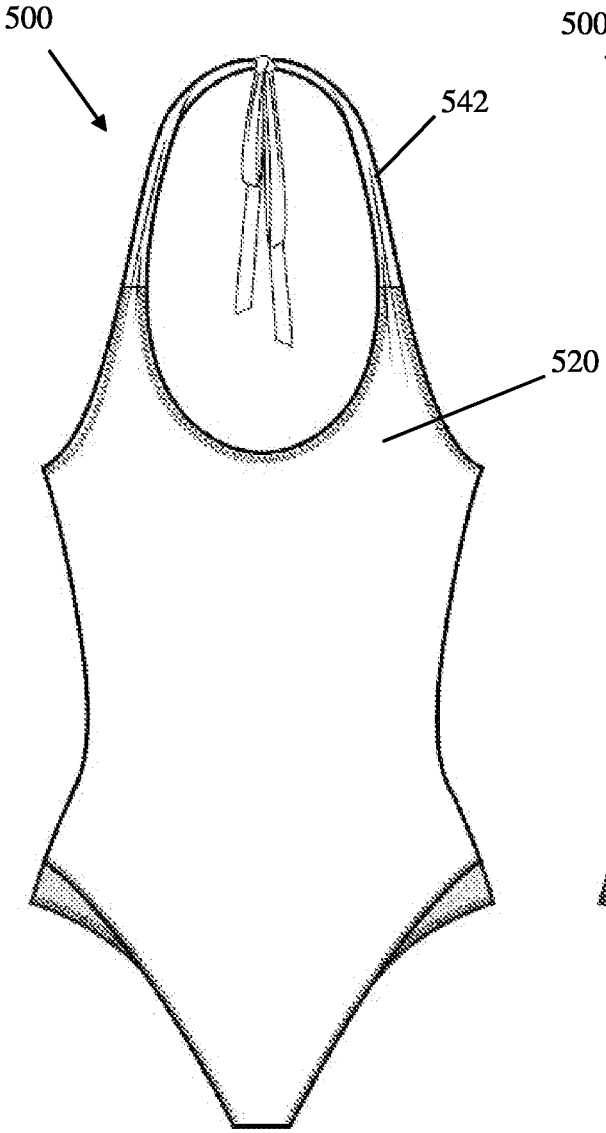
FIG. 5A is a front view of the outer fabric portion of a one-piece swimsuit according to a fifth embodiment of the invention.
Figure 5B:
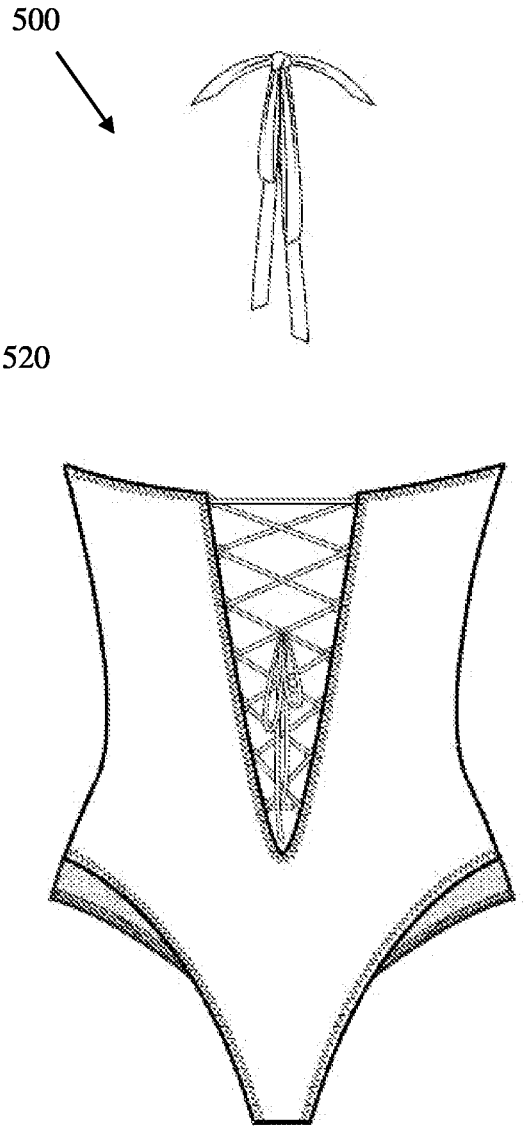
FIG. 5B is a rear view of the outer fabric portion of the one-piece swimsuit of FIG. 5A.
Figure 5C:
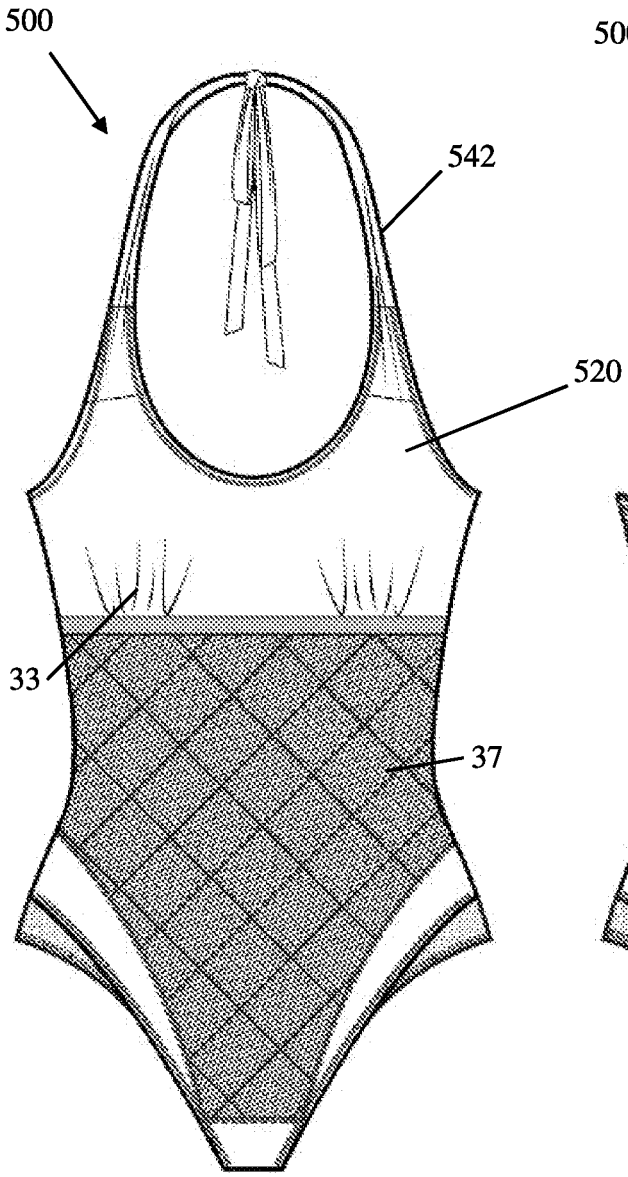
FIG. 5C is an inner view of the front of the one-piece swimsuit in FIG. 5A.
Figure 5D:
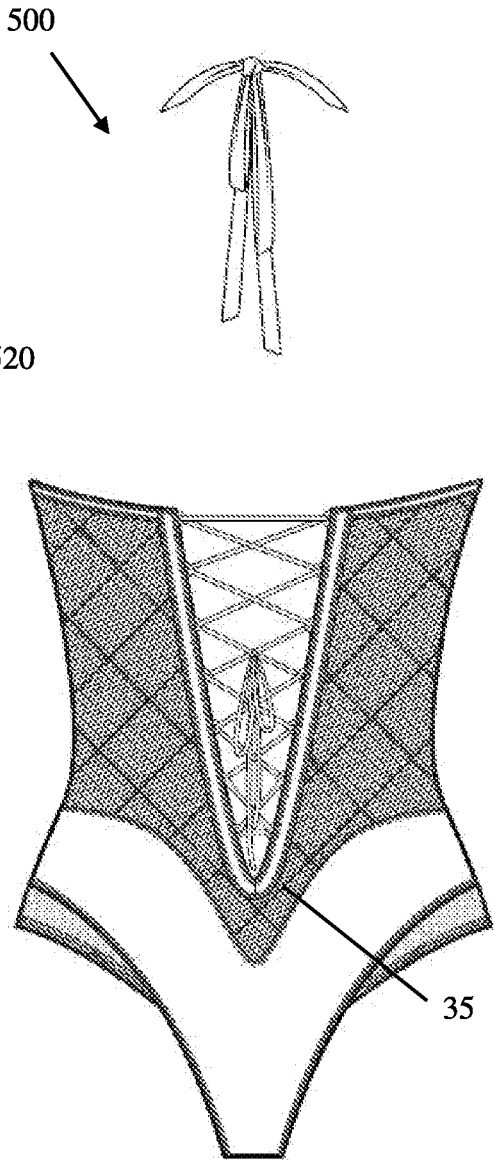
FIG. 5D is an inner view of the rear of the one-piece swimsuit in FIG. 5B.

FIGS. 2A and 2B show a second embodiment of the present invention. This second embodiment comprises a swimsuit 100 that includes an outer fabric portion 114 that is similar to the outer fabric portion 14 of the embodiment of FIGS. 1A and 1B, except for the following. The outer fabric portion 114 of the swimsuit 100 comprises an outer fabric layer 116*a* that has an hourglass shaped lower portion 118 that is smaller in width than the lower portion 18 of the swimsuit 10 of the first embodiment. The lower portion 118 is positioned between single layered self-start mesh fabric panels 150 of the outer fabric portion 114 that are located on the right and left sides of the swimsuit 100.

Each self-start mesh panel 150 is convexly curved at its upper section and then slightly concavely curved at its lower section and is stitched at its side ends to the corresponding side ends of the hourglass shaped lower portion 118. The central compression fabric portion 30 has a higher elastic modulus than that of the outer fabric portion 114, the self-lining layer 16*b*, the end portions 26, and the mesh fabric panels 150. Also, in this second embodiment, the shoulder straps 142 are not crisscrossed at the rear side of the swimsuit 100. The inner fabric portion 12 as well as all other elements of this second embodiment are similar in structure and function to that of the first embodiment.

FIGS. 3A to 3D show a third embodiment of the present invention. This third embodiment comprises a swimsuit 300. The outer fabric portion 314 is similar to the outer fabric portion 14 of the embodiment of FIGS. 1A and 1B, except for the following. In this third embodiment, lacing 352 is provided instead of the zipper placket. A u-shaped opening 356 extends from the center of the upper end of the swimsuit 300 down along the central compression fabric portion 30 and terminates at a hip portion 35 of the swimsuit 300 that is at a height that is approximately that of the hips of the wearer of the swimsuit when the swimsuit 300 is worn on the wearer. The hip portion 35 is shaped to resemble the hips of the wearer of the swimsuit 300. The length of the opening 356 may be two-thirds of the distance from the center of the upper end of the swimsuit 300 to the lower end of crotch panel 44.

The lacing 352 extends across the u-shaped opening 356. The lacing 352 extends through eyelets 354 that are located along the opposing inner ends that define the opening 356 at the back of the swimsuit 300. The lacing 352 enables or helps the wearer to easily put on and take off the swimsuit 300, since without the lacing 352 or other suitable alternative fastener for the opening 356, the inelastic power mesh fabric would make putting on and off the swimsuit 300 more difficult. The straps 342 are not crisscrossed. The ends of the lacing 352 are tied together to help keep the straps 342 around the shoulders of a wearer of the swimsuit 300. Also, the decorative mesh is removed. The inner fabric portion 312 is similar to the inner fabric portion 12 of the first embodiment, except that the u-shaped opening in the center of the back of the swimsuit extends further down so that the lacing 352 extending across the opening 356 to better adjust the width of the opening to in turn adjust the waist size of the swimsuit 300.

In this third embodiment, the swimsuit 300 may expand by untying and loosening the lacing 352 to enable putting the swimsuit 300 on and off the wearer. The lacing 352 may be in the front or back of the swimsuit 300. The swimsuit 300 is put on by untying the lacing 352, extending the legs through the leg openings 24, pulling the swimsuit 300 over buttocks and thighs, extending the arms through the arm openings 22, placing the shoulder straps 342 over the shoulders, and then pulling and tying the ends of the lacing 352 together as desired to adjust the width of the opening 356. The shoulder straps 342 can then be adjusted to be tighter or looser around the shoulder as desired. The swimsuit 300 can be worn for swimming, sunbathing, or as a bodysuit. The other elements of this third embodiment are similar in structure and function to that of the first embodiment.

FIGS. 4A to 4D show a fourth embodiment of the present invention. This fourth embodiment comprises a swimsuit 400. The swimsuit 400 of this fourth embodiment is similar to the swimsuit 300 of the third embodiment except that the shoulder straps 442 are crisscrossed. All other elements of this fourth embodiment are similar in structure and function to that of the third embodiment.

FIGS. 5A to 5D show a fifth embodiment of the present invention. This fifth embodiment comprises a swimsuit 500. The swimsuit 500 of this fifth embodiment is similar to the swimsuit 300 of the third embodiment except that neck straps 542 are provided instead of the shoulder straps 342. The neck straps 542 extend behind the neck of a wearer from upper shoulder portions 520 of the self-lining layer with the ends of the neck straps 542 tied together. All other elements of this fifth embodiment are similar in structure and function to that of the third embodiment.

FIGS. 6A to 6D show a sixth embodiment of the present invention. This sixth embodiment comprises a two-piece swimsuit 600. The swimsuit 600 includes a top portion 602 and a bottom portion 603. The top portion 602 has a pair of cup portions 604. The cup portions 604 are attached to each other and cover the bust of the wearer. The cup portions 604 are made of an outer fabric layer 606*a* and a self-lining fabric layer 606*b*. Removable pads may be inserted through inner openings 643 (FIG. 6C) of inner pockets 645 formed by the outer fabric layer 606*a* and the self-lining layer 606*b* at the cup portions 604. Neck straps 642 are attached to the cup portions 604 and extend behind the neck of a wearer with the ends of the neck straps 642 tied together. Back straps 647 are attached to the cup portions 604 and extend behind the back of the wearer of the swimsuit 600 with the ends of the back straps 647 tied together.

Figure 6A:
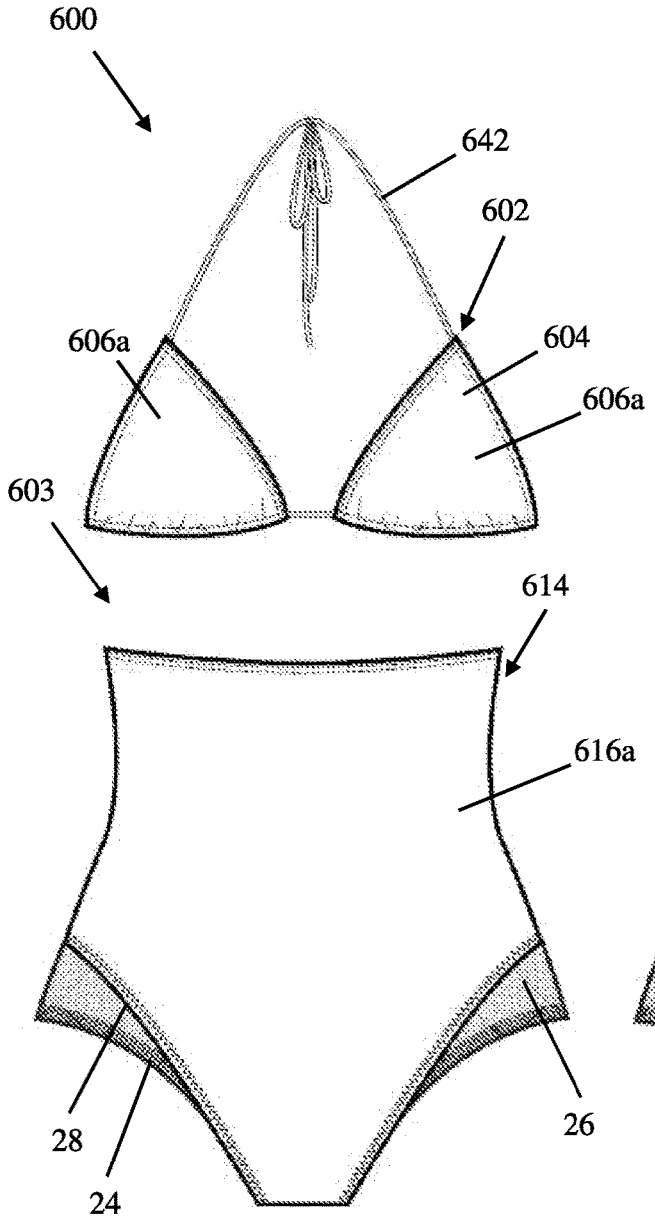
FIG. 6A is a front view of the outer fabric portion of a two-piece swimsuit according to a sixth embodiment of the invention.
Figure 6B:
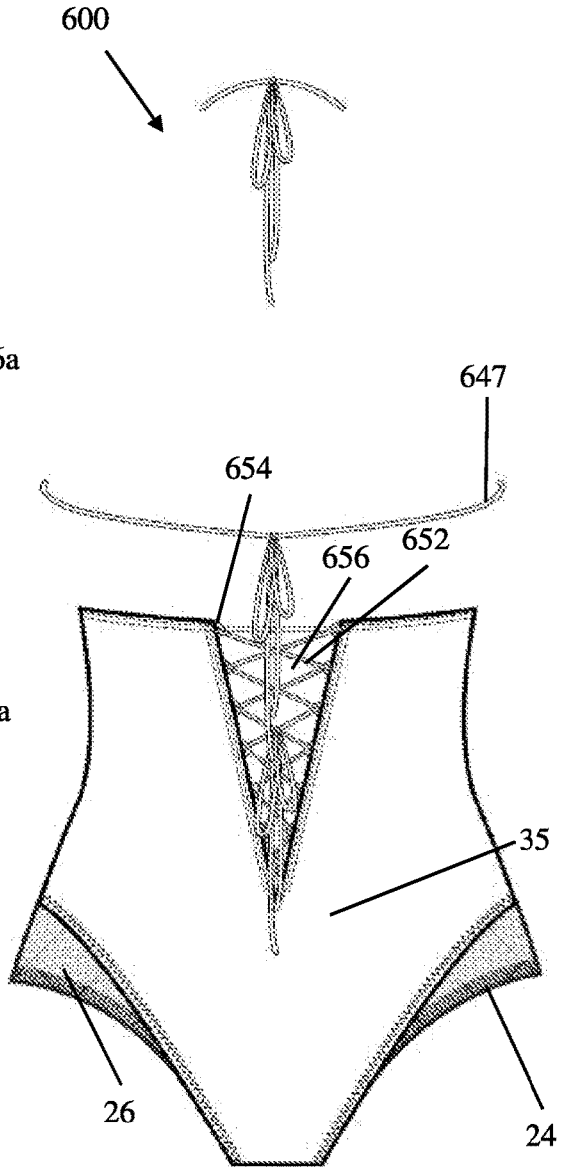
FIG. 6B is a rear view of the outer fabric portion of the two-piece swimsuit of FIG. 6A.

As seen in FIGS. 6A and 6B, the bottom portion 603 comprises an outer fabric portion 614 that has an outer fabric layer 616*a*. Like the third embodiment, the swimsuit 600 includes leg openings 24 of the swimsuit that are defined by end portions 26. Each end portion 26 comprises a single layer of self-start mesh. The self-start mesh layer uses the natural edge of the fabric created during knitting and does not require a hem, binding or finishing at the edge that may contribute to bulging and may unravel over time. The end portions 26 are attached by stitching, bonding or other suitable way to outer side ends 28 of the self-lining layer 616.

Figure 6C:
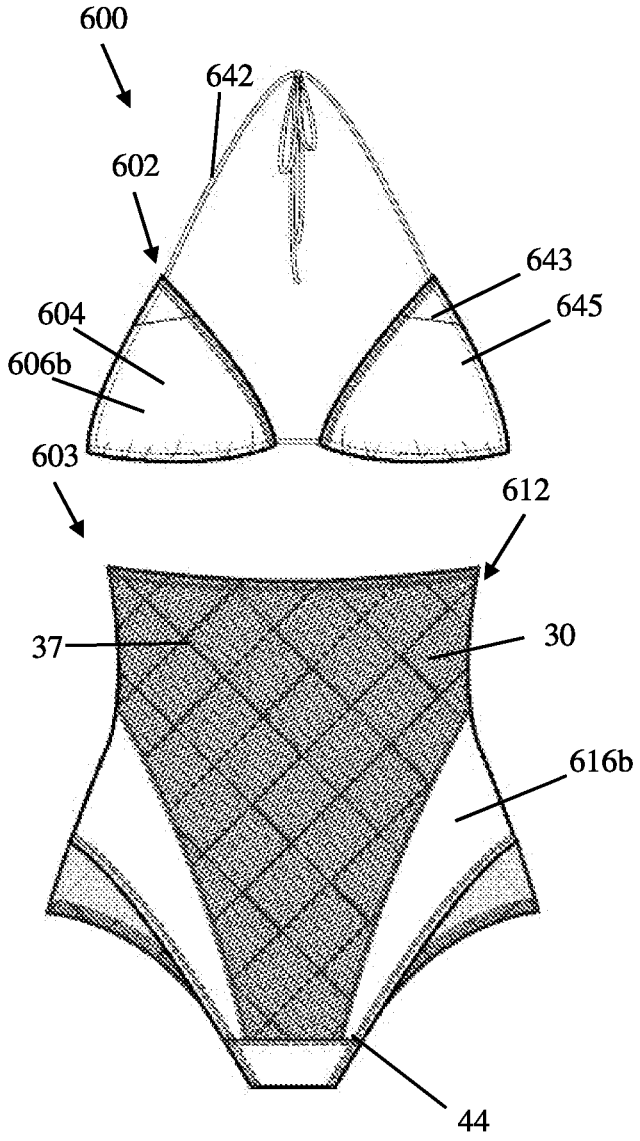
FIG. 6C is an inner view of the front of the two-piece swimsuit in FIG. 6A.
Figure 6D:
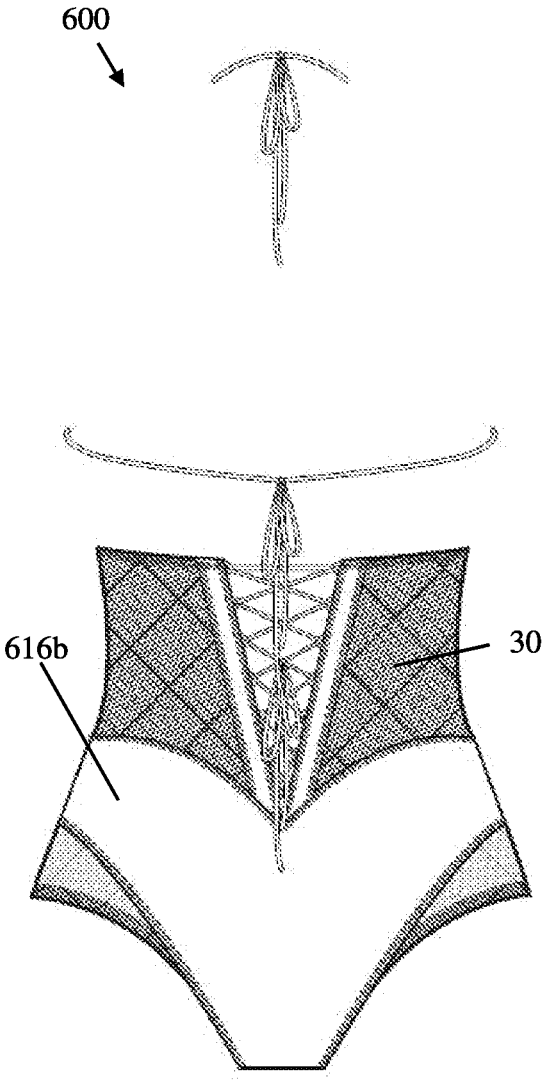
FIG. 6D is an inner view of the rear of the two-piece swimsuit in FIG. 6B.
Figure 8:
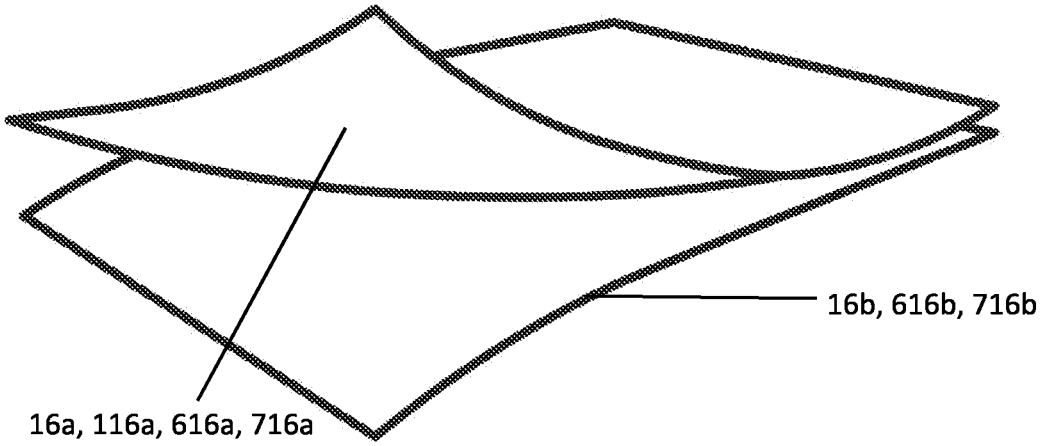
FIG. 8 is a schematic partial exploded view of a portion of the outer fabric layer positioned on the self-lining layer according to the present invention.

As seen in FIGS. 6C and 6D, the bottom portion 603 has an inner fabric portion 612 that comprises the central compression fabric portion 30 and a self-lining layer 616*b*. The central compression fabric portion 30 comprises outer and inner compression layers 30*a*, 30*b* (FIG. 9) that form a double layer of power mesh fabric. The outer and inner second compression layers 30*a*, 30*b* of the power mesh fabric are attached to each other and to the outer fabric layer 616*a* with the outer fabric layer 616*a* positioned over the outer layer 30*a* as illustrated in FIG. 9. The outer fabric layer 616*a* is also attached to the self-lining layer 616*b* and covers the self-lining layer 616*b* as illustrated in FIG. 8. The central compression fabric portion 30 is substantially an hourglass shape and fits around the waist, belly, and lower back areas of a wearer but does not cover the bust, upper back, and buttock areas. The central compression fabric portion 30 extends from just below the wearer's chest or bust to just above the respective bottom edges of the self-lining layer 616*b*. The central compression fabric portion 30 also extends laterally between the side ends 28 of the self-lining layer 616*b* near the leg openings 24.

The central compression fabric portion 30 comprises a waist covering portion 37 that is located inside the garment waist and reduces waist girth and stomach protrusion when the swimsuit is worn. The power mesh fabric of the central compression fabric portion 30 may be made of 100 percent nylon. The power mesh fabric acts as a heavy weight compression layer and is much less elastic than swimwear fabrics primarily composed of lycra or spandex or other elastic fiber type material. The central compression fabric portion 30 has a higher elastic modulus than that of the outer fabric portion 614, the self-lining layer 616*b*, and the end portions 26. The power mesh fabric of the central compression fabric portion 30 provides superior hold and sculpting benefits due to its lack of stretch. It is also lightweight and does not add bulk to garments.

A u-shaped opening 656 (FIG. 6B) extends from the center of the upper end of the bottom portion 603 down along the central compression fabric portion 30 and terminating at a hip portion 35 of the swimsuit 600 that is at a height that is approximately that of the hips of the wearer of the swimsuit when the swimsuit 600 is worn on the wearer. The hip portion 35 is shaped to resemble the hips of the wearer of the swimsuit 600. The length of the opening 656 may be one-half of the distance from the center of the upper end of the bottom portion 603 to the lower end of crotch panel 44. The lacing 652 extends across the u-shaped opening 656. The lacing 652 extends through eyelets 654 that are located along the opposing inner ends that define the opening 656 at the back of the swimsuit 600. The ends of the lacing 652 are tied together. The lacing 652 enables or helps the wearer to easily put on and take off the bottom portion 603, since without the lacing 652 or other suitable alternative fastener for the opening, the inelastic power mesh fabric would make putting on and off the swimsuit 600 more difficult.

In this sixth embodiment, the bottom portion 603 of the swimsuit 603 may expand by untying and loosening the lacing 652 to enable putting the swimsuit 600 on and off the wearer. The lacing 652 may be in the front or back of the swimsuit 600. The swimsuit 600 is put on by untying the lacing 652, extending the legs through the leg openings 24, pulling the bottom portion 603 to just below the bust, and then pulling and tying the ends of the lacing 652 together as desired to adjust the width of the opening 656. The top portion 602 is then put on with the cup portions 604 covering the bust. The neck straps 642 are extended behind the neck of a wearer with the ends of the neck straps 642 tied together. The back straps 647 are also extended behind the back of the wearer of the swimsuit 600 with the ends of the back straps 647 tied together. All other elements of this sixth embodiment are similar in structure and function to that of the third embodiment.

FIGS. 7A to 7D show a seventh embodiment of the present invention. This seventh embodiment comprises a two-piece swimsuit 700. The swimsuit 700 includes a top portion 702 and a bottom portion 703. The top portion 702 has a bust covering portion 704. The top portion 702 includes an elastic doubled on fold self-band 705 below the bust covering portion 704. The bust covering portion 704 is made of an outer fabric layer 706*a* and a self-lining fabric layer 706*b*. Removable pads may be inserted through inner openings 743 (FIG. 7C) of inner pockets 745 formed by the layers 706*a*, 706*b* at the bust covering portion 704. Adjustable shoulder straps 742 are attached to the top portion 702 and extend over the shoulder when the swimsuit 700 is worn by the wearer with the ends of the shoulder straps 742 tied together. The top portion 702 has clasps 711 on the back for fastening the side ends of the top portion 702 together.

Figure 7A:
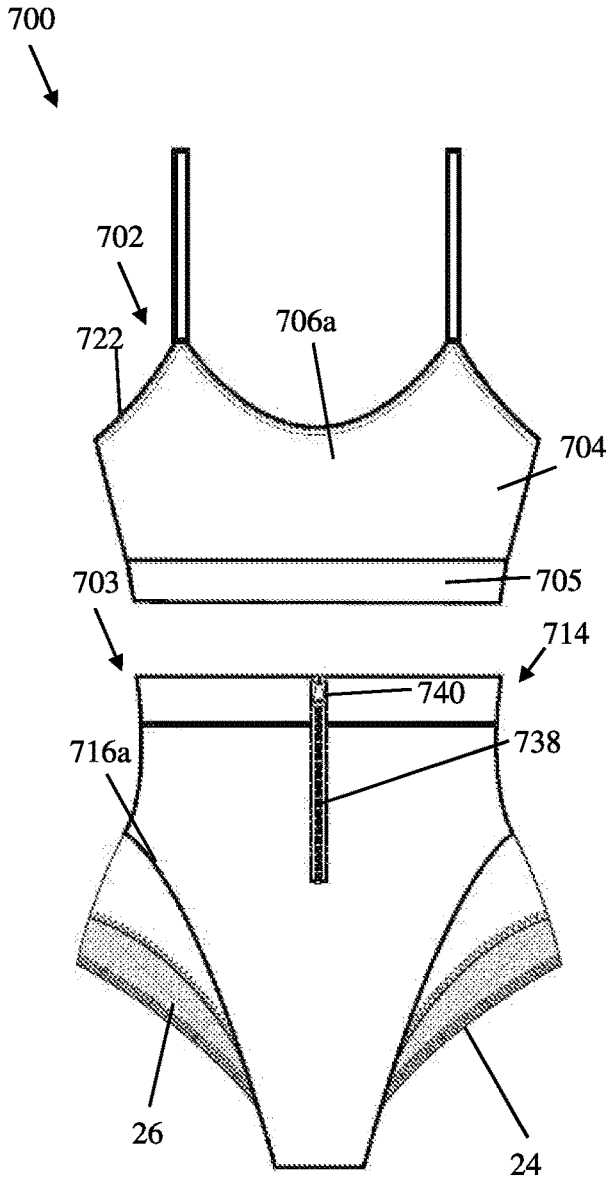
FIG. 7A is a front view of the outer fabric portion of a two-piece swimsuit according to a seventh embodiment of the invention.
Figure 7B:
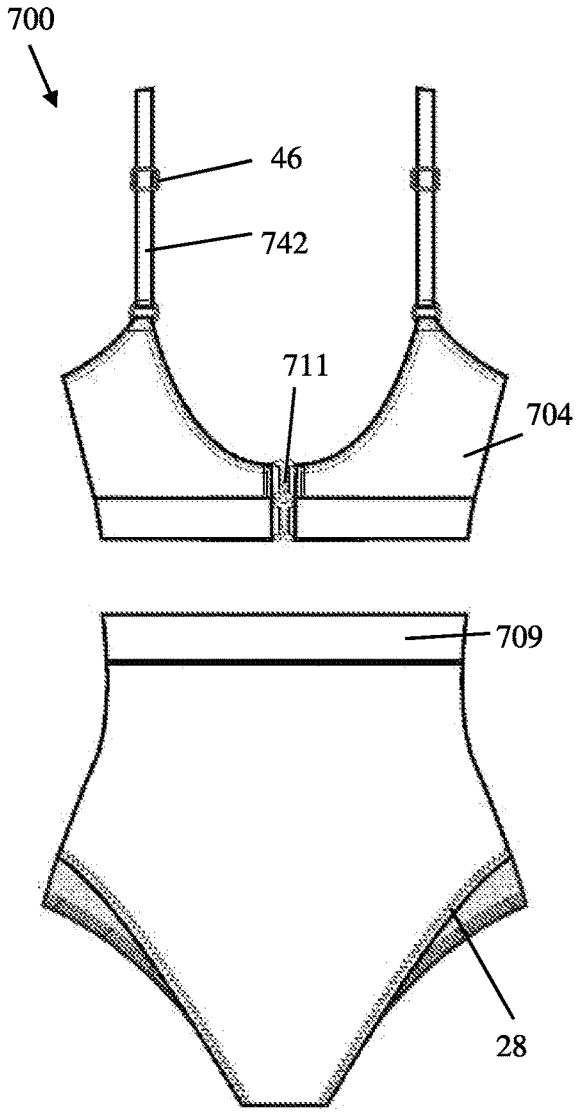
FIG. 7B is a rear view of the outer fabric portion of the two-piece swimsuit of FIG. 7A.

As seen in FIGS. 7A and 7B, the bottom portion 703 comprises an outer fabric portion 714 that has an outer fabric layer 716*a*. Like the sixth embodiment, the swimsuit 700 includes leg openings 24 of the swimsuit that are defined by end portions 26. Each end portion 26 comprises a single layer of self-start mesh. The self-start mesh layer uses the natural edge of the fabric created during knitting and does not require a hem, binding or finishing at the edge that may contribute to bulging and may unravel over time. The end portions 26 are attached by stitching, bonding or other suitable way to outer side ends 28 of the self-lining layer 716.

Figure 7C:
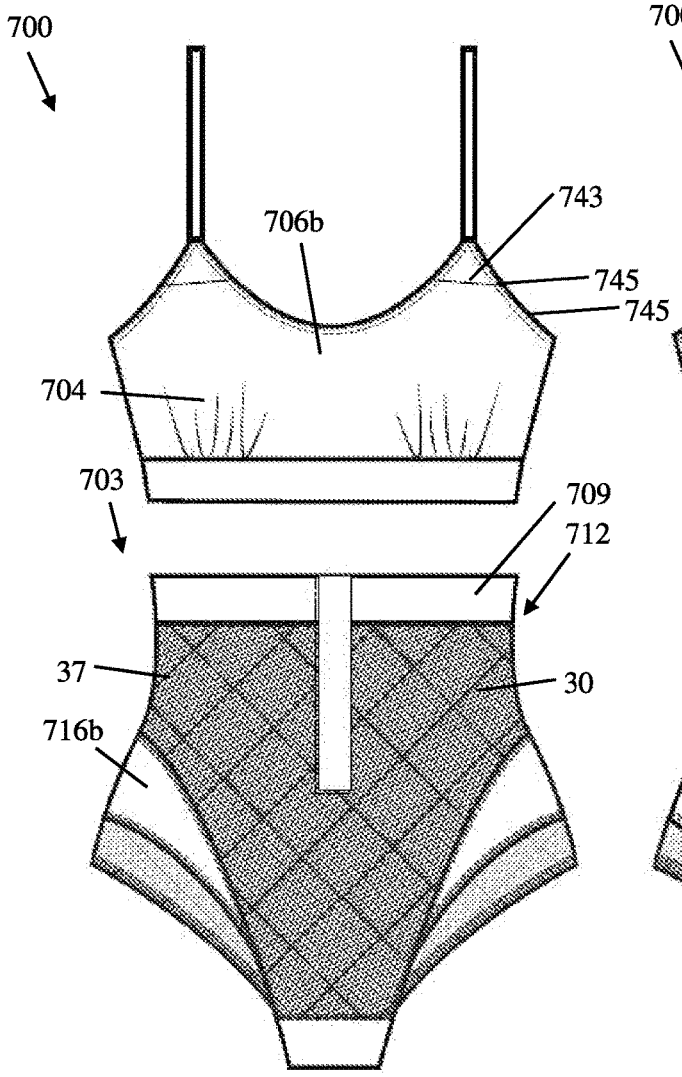
FIG. 7C is an inner view of the front of the two-piece swimsuit in FIG. 7A.
Figure 7D:
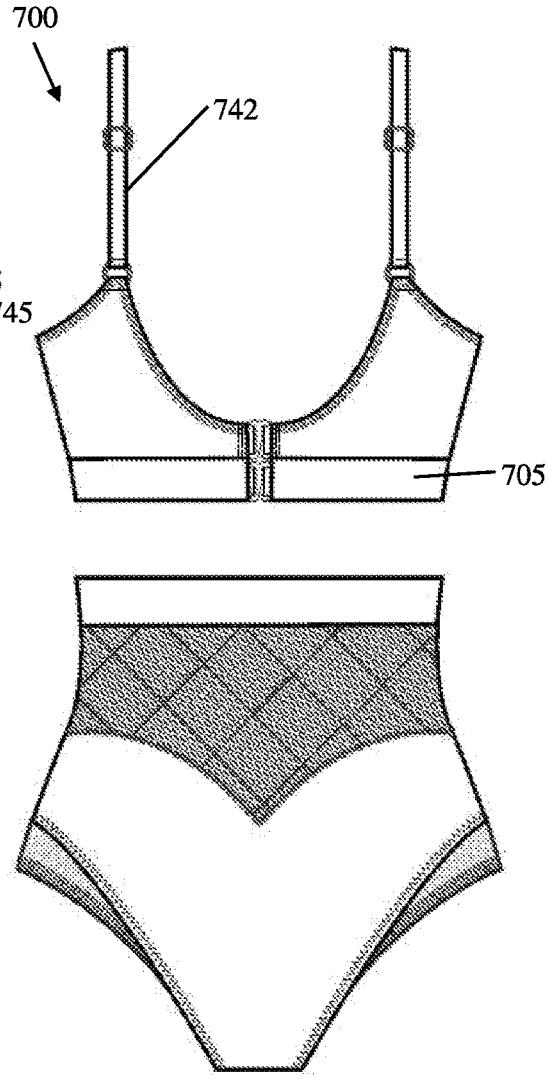
FIG. 7D is an inner view of the rear of the two-piece swimsuit in FIG. 7B.

As seen in FIGS. 7C and 7D, the bottom portion 703 has an inner fabric portion 712 that comprises a central compression fabric portion 30. The central compression fabric portion 30 comprises outer and inner compression layers 30*a*, 30*b* (FIG. 9) that form a double layer of power mesh fabric. The outer and inner second compression layers 30*a*, 30*b* of the power mesh fabric are attached to each other and to the outer fabric layer 716*a* with the outer fabric layer 716*a* positioned over the outer layer 30*a* as illustrated in FIG. 9. The outer fabric layer 716*a* is also attached to the self-lining layer 716*b* and covers the self-lining layer 716*b* as illustrated in FIG. 8. The central compression fabric portion 30 is substantially an hourglass shape and fits around the waist, belly, and lower back areas of a wearer but does not cover the bust, upper back, and buttock areas. The central compression fabric portion 30 extends from below the wearer's chest or bust to just above the respective bottom edges of the self-lining layer 16. The central compression fabric portion 30 also extends laterally between the side ends of the self-lining layer 716 near the leg openings 24. The bottom portion 703 also includes a doubled-on fold self-band 709 located just above the central compression fabric portion 30.

The central compression fabric portion 30 comprises a waist covering portion 37 that is located inside the garment waist and reduces waist girth and stomach protrusion when the swimsuit is worn. The power mesh fabric of the central compression fabric portion 30 may be made of 100 percent nylon. The power mesh fabric acts as a heavy weight compression layer and is much less elastic than swimwear fabrics primarily composed of lycra or spandex or other elastic fiber type material. The central compression fabric portion 30 has a higher elastic modulus than that of the outer fabric portion 14, which includes the self-lining layer 716 and the end portions 26. The power mesh fabric of the central compression fabric portion 30 provides superior hold and sculpting benefits due to its lack of stretch. It is also lightweight and does not add bulk to garments.

A central zipper placket 738 is stitched, bonded, or otherwise attached to the swimsuit 700 and extends from the center of the upper end of the bottom portion 703 down along the central compression fabric portion 30 and terminating at a hip portion 35 of the swimsuit 10. The zipper placket 738 includes a zipper 740 (FIG. 7A) that removably binds opposing edges of an opening defined by the zipper placket 738 to open and close the opening. The zipper placket 738 enables or helps the wearer to easily put on and take off the bottom portion 703, since without the zipper placket 738 or other suitable alternative fastener for the opening, the inelastic power mesh fabric would make putting on and off the swimsuit 700 more difficult.

The swimsuit 700 may expand by unzipping it to enable the bottom portion 703 to be put on and off by the wearer. The zipper placket 738 may be in the front or back and may be visible or an invisible. The single mesh layer 26 at the leg opening maybe be sheer or opaque.

The swimsuit 700 is put on by using the zipper 740 to unzip the opening defined by the zipper placket 738, extending the legs through the leg openings 24, pulling the bottom portion 703 over the buttocks and thighs, and using the zipper 740 to zip up the opening defined by the zipper placket 738. The top portion 702 is put on by extending the arms through the arm openings 22, placing the shoulder straps 742 over the shoulders, and then fastening the clasps 711 together. All other elements of this seventh embodiment are similar in structure and function to that of the sixth embodiment.

Referring now to FIG. 10 through FIG. 14-2, in one embodiment, a garment 1000 is shown which, for illustrative purposes only, is a one-piece style women's swimsuit. It should be noted, however, that other types of garments such as lingerie (not shown), dresses (as shown in FIG. 15 through FIG. 17-2) and tops (as shown in FIG. 18 through FIG. 20-2) may incorporate the features of the present disclosure and are not limited to garments only for women.

Figure 10:
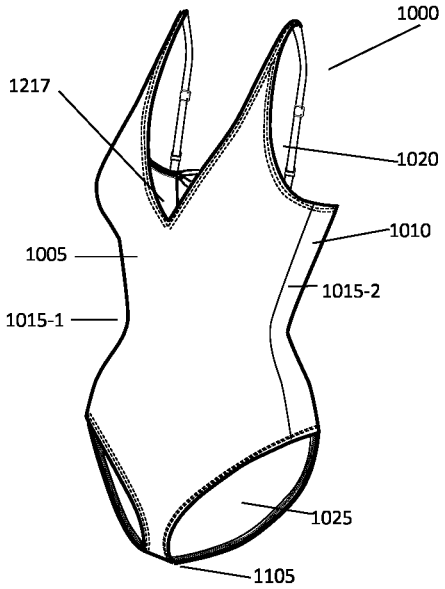
FIG. 10 is a perspective view of an exemplary garment, i.e., a bathing suit, in accordance with one embodiment the present disclosure.
Figure 11:
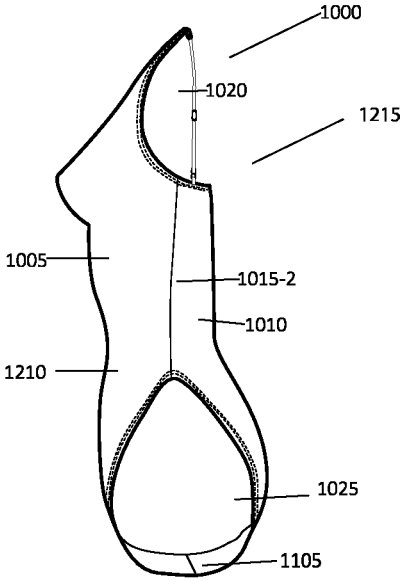
FIG. 11 is a side view of the garment of FIG. 10.

The swimsuit 1000 includes a front panel 1005 and a back panel 1010 attached to one another by a first side seam 1015-1 and a second side seam 1015-2, where only the second side seam 1015-2 is visible in FIG. 10, and by a seam 1105 at the crotch portions of the front and back panels 1005, 1010 as shown in FIG. 11. The front and back panels 1005, 1010 may be formed as a single continuous piece of fabric (as shown in FIG. 11), or using any other method known to those of skill in the art. Several methods of attachment, as known to those of ordinary skill in the art, may be used to attach the front and back panels 1005, 1010. When attached, the front and back panels 1005, 1010 at least define arm openings 1020 and leg openings 1025, as shown.

Figures 1, 12:
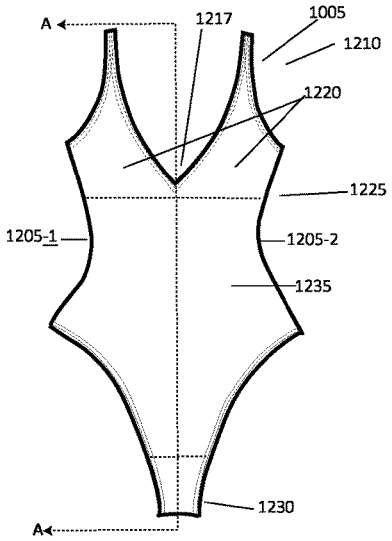
FIGS. 12-1 and 12-2 are views of an outer facing surface and an inner facing surface, respectively, of a front panel component of the garment of FIG. 10.
Figures 2, 12:
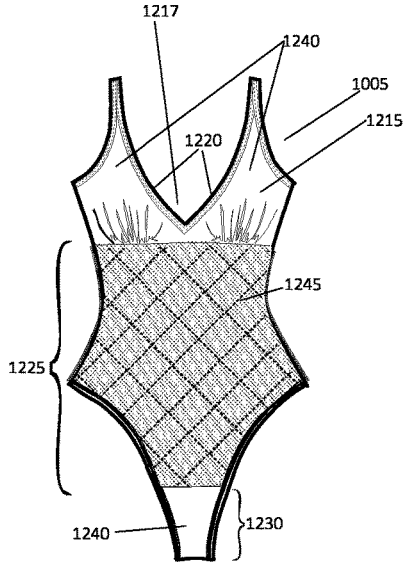
Figure 13:
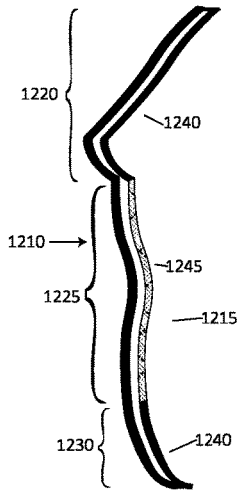
FIG. 13 is a cross-sectional view along line A-A of the front panel shown in FIG. 12-1.

Referring now to FIG. 12-1 and FIG. 12-2, the front panel 1005 is generally an hourglass shape and has two concave sides or edges 1205-1, 1205-2. The front panel 1005 may include a front outer facing surface 1210 and an inner facing surface 1215.

The front panel 1005 may include an opening 1217, like the openings of the other embodiments, to aid the wearer in putting on the garment. The opening 1217 may be closed by any of the approaches described herein, for example, but not limited to, a zipper, lacing, or clasp. As discussed in other embodiments of the present disclosure, in lieu of (or in addition to) the front panel opening 1217, the back panel 1010 may include an opening 1402 that may also be closed by any of the approaches described herein (e.g., zipper (shown in FIGS. 1A, 1C and 2A), lacing (as shown in FIGS. 3B, 3D, 4B, 4D, 5B, 5D, 6B and 6D), clasp, or the like).

Each of the inner and outer facing surfaces 1210, 1215 may include a pectoral portion 1220, a torso portion 1225, and a crotch portion 1230. Generally, for purposes of the present disclosure, the torso portion 1225 is between the pectoral portion 1220 and the crotch portion 1230. The outer facing surface 1215 is that which is seen when the garment is worn while the inner facing surface 1210 is against the skin of the wearer. The pectoral portion 1220 is generally defined as the bust area of a woman and can have components as described herein in reference to the other embodiments of this disclosure, including components similar to those found in bras.

The front panel 1005 may include multiple layers of material as shown in FIG. 12-1, FIG. 12-2 and FIG. 13. An outer fabric layer 1235 may be provided as the outer facing surface 1210 and is similar to the outer fabric layers 1235 described herein with respect to other embodiments. The inner facing surface 1215 of the front panel 1005 may include self-lining material 1240 in the crotch portion 1230 and the pectoral portion 1220. A compression layer 1245 may be provided in the torso portion 1225 of the inner facing surface 1215 of the front panel 1005 between the crotch portion 1230 and the pectoral portion 1220.

The compression layer 1245 of the front panel 1005 generally has a higher elastic modulus than the material of the outer fabric layer 1235 and/or the self-lining material 1240. The compression layer 1245 may be of a similar multi-layer construction as described herein with reference to other embodiments. For example, the compression layer 1245 may be formed of a power mesh fabric, including a double layer power mesh fabric or any other material that provides a higher elastic modulus than the material of the outer fabric layer 1235 and/or the self-lining 1240. As described herein with reference to other embodiments, the power mesh fabric may be made of 100 percent nylon or other materials such as spandex, polyester, or combinations thereof.

The outer facing surface 1235 and the inner facing surface 1215 of the front panel 1005 may be attached at the first and second side seams 1015-1, 1015-2 (as shown in FIG. 10 and FIG. 11) and seam 1105 (shown in FIG. 10 and FIG. 11) of the garment 1000, which for illustrative purposes only is a swimsuit. One of ordinary skill in the art will understand that the seams can be created by any number of different approaches including, but not limited to, stitching, bonding, adhesives, and the like. A garment of the present disclosure may also include a seamless construction.

Figures 1, 14:
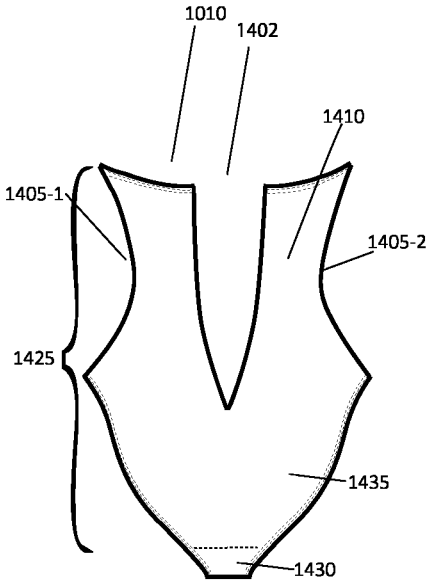
Figures 2, 14:
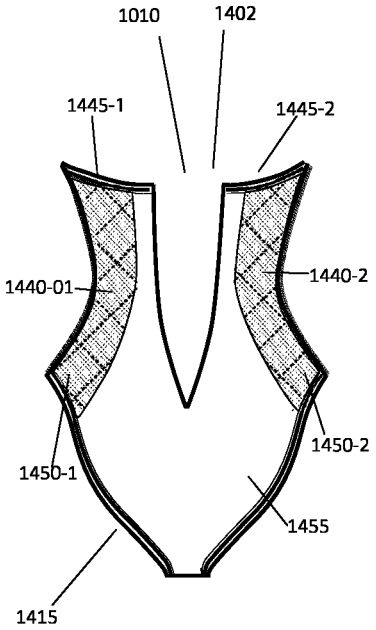

Referring now to FIG. 14-1 and FIG. 14-2, the back panel 1010 of the swimsuit 1000 (or other garment) is generally an hourglass shape and has two concave sides or edges 1405-1, 1405-2, like the front panel 1005. The back panel 1010 may include a back outer facing surface 1410 and an inner facing surface 1415. Each of the inner and outer facing surfaces 1410, 1415 may include a torso portion 1425 and a crotch portion 1430. Generally, the back panel 1010 does not include a pectoral portion, as is provided on the front panel 1005, as the back panel 1010 generally does not rise that high up on the back of the wearer. However, for other types of garments, the back panel may include an upper back portion (not shown). The outer facing surface 1410 is that which is seen when the garment is worn while the inner facing surface 1415 is against the skin of the wearer.

The back panel 1010 may include multiple layers of material. For example, an outer fabric layer 1435 may be provided as the outer facing surface 1410 and is like the outer fabric layers described herein in other embodiments. The inner facing surface 1415 may include a first arcuate or concave portion 1440-1 of compression material layer 1441-1 and a second arcuate or concave portion 1440-2 of compression material layer 1441-2. These two arcuate areas 1440-1, 1440-2 extend from a top of the torso portion 1445-1, 1445-2 to a respective upper portion of the leg openings 1450-1, 1450-2 and generally follow the hourglass curvature of the front and back panels 1005, 1010 at the seams (not shown). Self-lining material 1455 extends from the crotch portion 1430 up to the top of the torso portion 1445-1, 1445-2 between the two arcuate portions 1440-1, 1440-2 and separates the arcuate portions of compression material 1441-1,1441-2 from one another. The compression layer material 1441-1,1441-2 generally has a higher elastic modulus than the material of the outer fabric layer 1435 and the self-lining material 1455. The compression layer 1441-1,1441-2 may be of a similar multi-layer construction as described herein with reference to the other embodiments. For example, compression 1441-1,1441-2 may be formed of a power mesh fabric, including a double layer power mesh fabric or any other material that provides a higher elastic modulus than the material of the outer fabric layer 1435 and/or the self-lining 1455. As described herein with reference to other embodiments, the power mesh fabric may be made of 100 percent nylon or other materials such as spandex, polyester, or combinations thereof.

Advantageously, the compression material 1245, 1441-1, 1441-2 in the front and back panels 1005, 1010 and the selective placement of the back panel 1010 compression material 1441-1,1441-2 operate to give the wearer a garment that provides the desired hourglass shape—i.e., improved fit without creating bulging on the body of the wearer and/or the garment itself. Further, the garment is relatively easy to get on, and wear, due to, for example, the self-lining material between the arcuate portions of compression material in the back panel and/or the openings 1217 and 1402. While the compression material is less elastic than the self-lining material, the back panel can stretch as the wearer puts on the garment. Once on, the self-lining material will contract while the arcuate compression portions conform the sides of the wearer.

Figure 15:
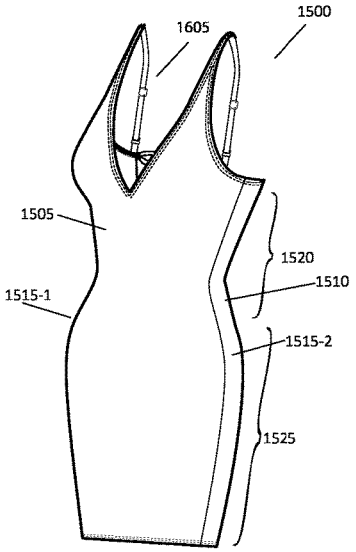
FIG. 15 is a perspective view of a garment, i.e., a dress, in accordance with an aspect of the present disclosure.

Referring now to FIG. 15, in another embodiment, a dress 1500 incorporates a front panel 1505 and a back panel 1510 attached to one another by a first side seam 1515-1 and a second side seam 1515-2, where only the second side seam 1515-2 is visible in FIG. 15. The construction of the dress 1500 is comparable to the swimsuit embodiments of FIG. 10 through FIG. 14-2. Each of the front and back panels 1505, 1510 has an hourglass shaped top portion 1520, similar to the bathing suit 1000, with a dress lower portion 1525. As will be discussed below, compression layers in the front and back panels 1505, 1510 and the selective placement of the back panel 1510 compression layer material 1723-1,1723-2 within the arcuate portions function to provide the desired hourglass shape to the wearer of the dress without creating bulging on the body of the wearer or the garment itself.

Figures 1, 16:
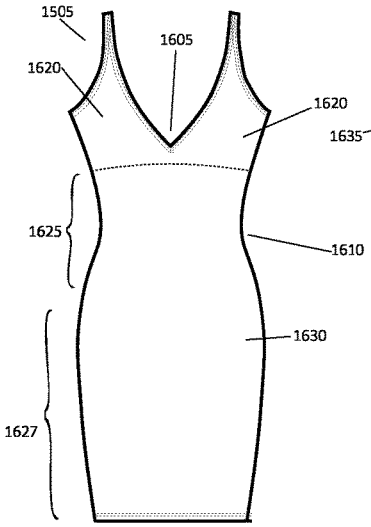
Figures 2, 16:
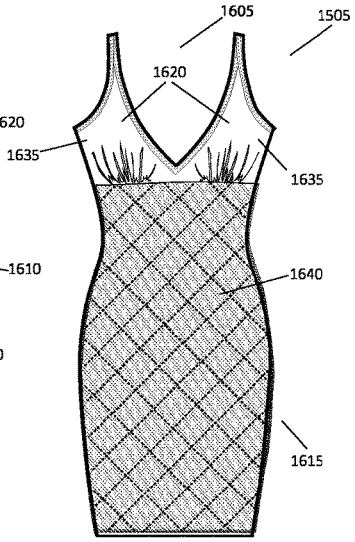

Referring now to FIG. 16-1 and FIG. 16-2, the front panel 1505 is generally an hourglass shape at the torso portion 1520 and has two concave sides or edges to define an hourglass shape on the wearer. The front panel 1505 may include an opening 1605, similar to the openings of the other embodiments, to aid the wearer in putting on the garment. The opening 1605 may be closed by any of the approaches described herein, for example, but not limited to, a zipper, lacing, or clasp. The front panel 1505 has a front outer facing surface 1610 and an inner facing surface 1615. Each of the inner and outer facing surfaces 1610, 1615 includes a pectoral portion 1620 a torso portion 1625 and a dress lower portion 1627. Generally, the torso portion 1625 is below the pectoral portion 1620. The outer facing surface 1610 is that which is seen when the garment is worn while the inner facing surface is against the skin of the wearer. The pectoral portion 1620 is generally defined as the bust area of a woman and can have components as described herein in reference to the other embodiments of this disclosure.

The front panel 1505 may include multiple layers of material as shown in FIG. 16-1 and FIG. 16-2. An outer fabric layer 1630 may be provided as the outer facing surface and is similar to the outer fabric layers described herein with respect to other embodiments. The inner facing surface 1610 may include self-lining material 1635 in the pectoral portion 1620. A compression layer 1640 is provided in the torso portion 1625 and the lower dress portion 1627 of the inner facing surface 1610 down to the lower portion of the garment. The compression layer 1640 generally has a higher elastic modulus than the material of the outer fabric layer 1630 and the self-lining material 1635. The compression layer 1640 may be of a similar multi-layer construction as described herein with reference to the other embodiments. The outer facing surface 1615 and the inner facing surface 1610 are attached at the first and second side seams 1515-1, 1515-2 of the garment. One of ordinary skill in the art will understand that the seams can be created by any number of different approaches including, but not limited to, stitching, bonding, adhesives, and the like.

Figures 1, 17:
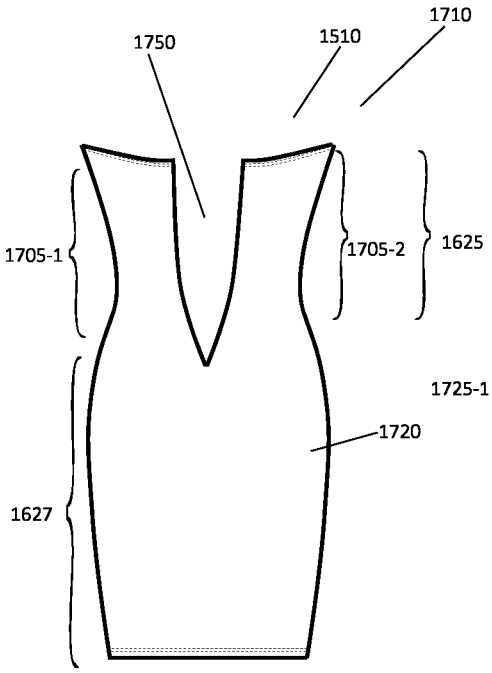
Figures 2, 17:
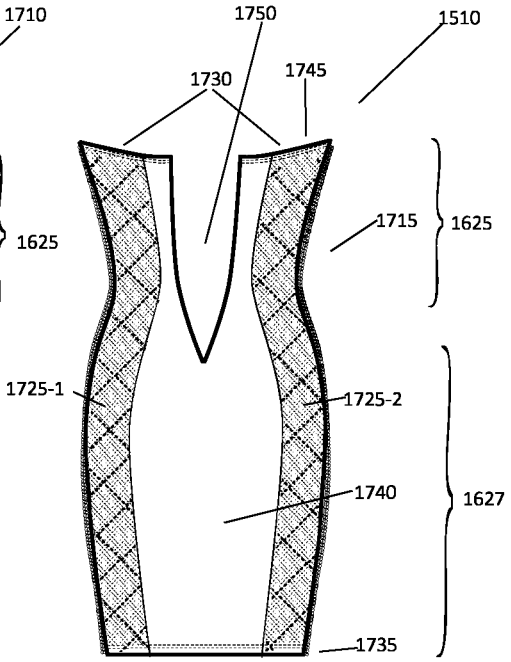

Referring now to FIG. 17-1 and FIG. 17-2, the back panel 1510 is generally an hourglass shape and has two concave sides or edges 1705-1, 1705-2 like the front panel 1505. The back panel 1510 has a back outer facing surface 1710 and an inner facing surface 1715. Each of the inner and outer facing surfaces 1710, 1715 includes the torso portion 1625 and the lower dress portion 1627. Generally, the back panel 1510 does not include a pectoral portion as the back panel does not rise that high up on the back of the wearer. The outer facing surface is that which is seen when the garment is worn while the inner facing surface is against the skin of the wearer.

The back panel 1510 comprises multiple layers of material. An outer fabric layer 1720 may be provided as the outer facing surface and is like the outer fabric layers described herein in other embodiments. The inner facing surface 1715 includes a first arcuate or concave portion 1725-1 of compression material 1723-1 and a second arcuate or concave portion 1725-2 of compression material 1723-2. These two arcuate areas 1725-1, 1725-2 extend from a top of the torso portion 1730 to a bottom portion of the dress opening 1735 and generally follow the hourglass curvature of the front and back panels 1505, 1510 at the first and second seams. Self-lining material 1740 extends from the bottom of the dress 1735 up to a top of the torso portion 1745 and separates the arcuate portions 1725-1, 1725-2 of compression layer material 1723-1,1723-2. The compression layer material 1723-1,1723-2 generally has a higher elastic modulus than the material of the outer fabric layer and the self-lining material. The compression layer may be of a similar multi-layer construction as described herein with reference to the other embodiments.

Advantageously, the compression material 1640, 1723-1, 1723-2 in the front and back panels 1505, 1510 of the dress 1500 operate to give the wearer a garment that provides the desired hourglass shape. Additionally, the selective placement of the back panel 1510 compression material layer 1723-1,1723-2 function to provide improved fit without creating bulging on the body of the wearer or the garment itself. Further, the garment is relatively easy to get on, and wear, due to, for example, the self-lining material between the arcuate portions of compression material in the back panel. While the compression material 1723-1,1723-2 is less elastic than the self-lining material, the back panel can stretch as the wearer puts on the garment. Once on, the self-lining material will contract while the arcuate compression portions conform the sides of the wearer.

A decorative mesh insert and zipper, as disclosed herein, may be provided in the opening 1605 in the front panel 1505 or in an opening 1750 in the back panel 1510 of the garment 1500 in FIGS. 15-17-2. For example, the openings 1605 and 1750 may be closed using a zipper, clasp, lacing or the like, as has been described herein.

Figure 18:
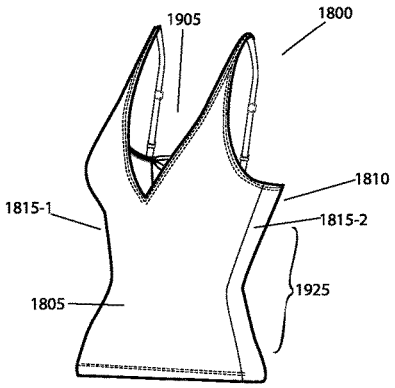
FIG. 18 is a perspective view of a garment, i.e., a top, in accordance with one embodiment of the present disclosure.

Referring now to FIG. 18, in another embodiment, a top 1800 incorporates a front panel 1805 and a back panel 1810 attached to one another by a first side seam 1815-1 and a second side seam 1815-2, where only the second side seam 1815-2 is visible in FIG. 18. The construction of the top 1800 is comparable to the swimsuit and dress embodiments of FIG. 10 through FIG. 17-2. Each of the front and back panels 1805, 1810 has an hourglass shaped top portion 1820, similar to the bathing suit 1000. As will be discussed below, compression layers in the front and back panels 1805, 1810 function to provide the desired hourglass shape to the wearer of the top.

Figures 1, 19:
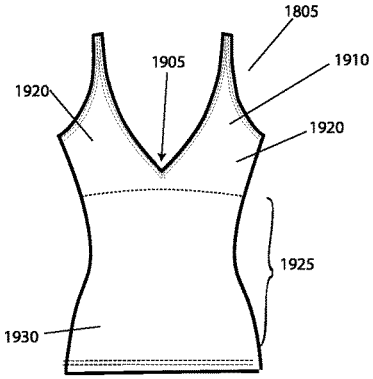
Figures 2, 19:
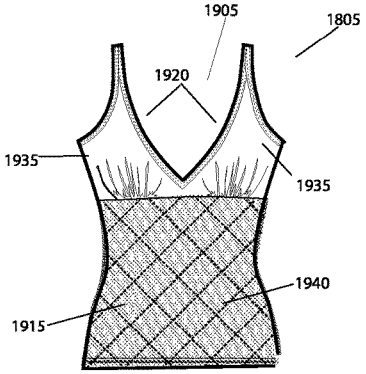

Referring now to FIG. 19-1 and FIG. 19-2, the front panel 1805 is generally an hourglass shape at the torso portion and has two concave sides or edges to define an hourglass shape on the wearer. The front panel 1805 may include an opening 1905, similar to the openings of the other embodiments, to aid the wearer in putting on the garment. The opening 1905 may be closed by any of the approaches described herein, for example, but not limited to, a zipper, lacing, or clasp. The front panel 1805 has a front outer facing surface 1910 and an inner facing surface 1915. Each of the inner and outer facing surfaces 1910, 1915 includes a pectoral portion 1920 and a torso portion 1925. Generally, the torso portion 1925 is below the pectoral portion 1920. The outer facing surface 1910 is that which is seen when the garment is worn while the inner facing surface is against the skin of the wearer. The pectoral portion 1920 is generally defined as the bust area of a woman and can have components as described herein in reference to the other embodiments of this disclosure.

The front panel 1805 may include multiple layers of material as shown in FIG. 19-1 and FIG. 19-2. An outer fabric layer 1930 may be provided as the outer facing surface and is similar to the outer fabric layers described herein with respect to other embodiments. The inner facing surface 1915 may include self-lining material 1935 in the pectoral portion 1920. A compression layer 1940 is provided in the torso portion 1925 of the inner facing surface from below the pectoral portion 1920 down to the lower portion of the garment. The compression layer 1940 generally has a higher elastic modulus than the material of the outer fabric layer 1930 and the self-lining material 1935. The compression layer 1940 may be of a similar multi-layer construction as described herein with reference to the other embodiments. The outer facing surface and the inner facing surface are attached at the first and second side seams 1815-1, 1815-2 of the garment. One of ordinary skill in the art will understand that the seams can be created by any number of different approaches including, but not limited to, stitching, bonding, adhesives, and the like.

Figures 1, 20:
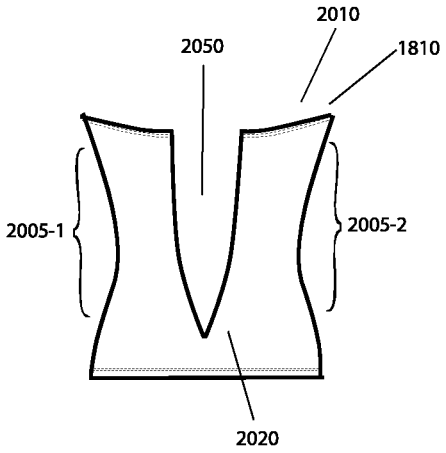
Figures 2, 20:
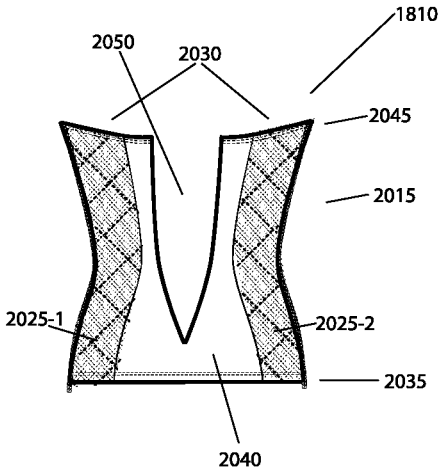

Referring now to FIG. 20-1 and FIG. 20-2, the back panel 1810 is generally an hourglass shape and has two concave sides or edges 2005-1, 2005-2 like the front panel 1805. The back panel 1810 has a back outer facing surface 2010 and an inner facing surface 2015. Each of the inner and outer facing surfaces 2010, 2015 includes the torso portion 1820. Generally, the back panel 1810 does not include a pectoral portion as the back panel 1810 does not rise that high up on the back of the wearer. The outer facing surface is that which is seen when the garment is worn while the inner facing surface is against the skin of the wearer.

The back panel 1810 may comprise multiple layers of material. An outer fabric layer 2020 may be provided as the outer facing surface and is similar to the outer fabric layers described herein in other embodiments. The inner facing surface 2015 includes a first arcuate or concave portion 2025-1 of compression material 2013-1 and a second arcuate or concave portions portion 2025-2 of compression material 2013-2. These two arcuate areas 2025-1, 2025-2 extend from a top of the torso portion 2030 to a bottom portion of the dress opening 2035 and generally follow the hourglass curvature of the front and back panels at the first and second seams. Self-lining material 2040 extends from the bottom 2035 up to a top of the torso portion 2045 and separates the arcuate portions 2025-1, 2025-2 of compression layer material 2013-1,2013-2. The compression layer material 2013-1, 2013-2 generally has a higher elastic modulus than the material of the outer fabric layer and the self-lining material. The compression layer 2013-1,2013-2 may be of a similar multi-layer construction as described herein with reference to the other embodiments, including the selective placement of compression material 2013-1, 2013-2 at arcuate areas of a back panel, as described in the present disclosure.

Advantageously, the compression material in the front and back panels of the top operate to give the wearer a garment that provides the desired hourglass shape. Further, the garment is relatively easy to get on, and wear, due to, for example, the self-lining material between the arcuate portions of compression material in the back panel. While the compression material is less elastic than the self-lining material, the back panel can stretch as the wearer puts on the garment. Once on, the self-lining material will contract while the arcuate compression portions conform the sides of the wearer.

A decorative mesh insert and zipper, as disclosed herein, may be provided in the opening 1905 in the front panel 1805 or in an opening 2050 in the back panel 1810 of the top 1800 in FIGS. 18-20-2. Similarly, lacing or a clasp may be provided as has been described.

Advantageously, aspects of the present disclosure provide for lifting the breasts, smoothing the stomach, reducing waist girth, prohibiting, or minimizing bulges of the buttocks and outer thigh at the leg opening and is relatively easy (considering the tight fit) to put on and take off because it can be unzipped or unlaced. Other aspects of the present invention provide maximum compression at the front and back waist and stomach but gradually reduces the amount of compression at the buttocks, hips, and thighs to create an hourglass shape without bulges at the leg opening.

Although various embodiments of the disclosed body sculpting garment have been shown and described, modifications may occur to those skilled in the art upon reading the specification. The present application includes such modifications and is limited only by the scope of the claims.

What is claimed is:

1. A garment, comprising:

a front panel having an outer fabric layer and an inner fabric layer, wherein the front panel inner fabric layer comprises lining material in each of a bottom portion and a pectoral portion of the front panel inner fabric layer and a compression layer material in a torso portion of the front panel inner fabric layer coupled to the lining material in each of the bottom and pectoral portions;

a back panel having an outer fabric layer and an inner fabric layer, wherein the back panel is coupled to the front panel at first and second seams such that the respective inner surfaces of each of the respective inner fabric layers face each other, and wherein the back panel comprises:

a torso portion of the back panel inner fabric layer comprising:

a right compressive panel formed from the compression layer material extending from the first seam towards a centerline and from an upper portion of the torso portion to a bottom portion of the torso portion;

a left compressive panel formed from the compression layer material extending from the second seam towards the centerline and from an upper portion of the torso portion to a bottom portion of the torso portion; and lining material extending between the right compressive panel and the left compressive panel, wherein the lining material of the inner fabric layer of the back panel is coupled to the right compressive panel and the left compressive panel by a fifth seam and a sixth seam, respectively; and lacing extending across the centerline of the back panel configured to adjust a waist size of the garment, wherein the lacing is coupled to a plurality of points along a third seam and a fourth seam of the back panel, and wherein:

ends of the lacing are capable of being tied together at a location proximate to a waist region of a wearer; and the lacing extends across a u-shaped portion that is defined in the torso portion of the back panel, wherein:

the u-shaped portion extends across the centerline of the back panel, and the u-shaped portion has a wider width at a top portion of the u-shaped portion as compared to a bottom portion of the u-shaped portion;

wherein the compression layer material has a higher elastic modulus than a respective elastic modulus of each of the front panel outer fabric layer, the back panel outer fabric layer, and the lining material of the front panel inner fabric layer and the back panel inner fabric layer, and wherein the compression layer material of the right compressive panel, the left compressive panel, and the compression layer material of the front panel inner fabric layer are the same material.

2. The garment of claim 1, wherein the garment comprises a bathing suit, further comprising:

first and second leg openings, defined by front and back panels at a bottom portion of the bathing suit, wherein the right and left compressive panels extend from the upper portion of the back panel to the first and second leg openings, respectively.

3. The garment of claim 1, further comprising:

a front opening, defined in the front panel, extending through the pectoral portion and terminating in the torso portion.

4. The garment of claim 3, further comprising:

at least one of a zipper, a lacing, and a clasp, provided in the front panel, configured to close and open the front opening.

5. The garment of claim 1, wherein the u-shaped portion is a u-shaped opening of the back panel that extends between the right compressive panel and the left compressive panel.

6. The garment of claim 1, wherein the compression layer material comprises multiple layers of material.

7. A dress, comprising:

a front panel having an outer fabric layer and an inner fabric layer, wherein the front panel comprises a lining material coupled to a compression layer material in a torso portion of the front panel inner fabric layer;

a back panel having an outer fabric layer and an inner fabric layer, wherein the back panel is coupled to the front panel at first and second seams such that the respective inner surfaces of each of the respective inner fabric layers face each other, and wherein the front panel outer fabric layer and the back panel outer fabric layer each comprise a torso portion and a lower dress portion comprising a dress opening;

wherein in a torso portion of the back panel inner fabric layer, the back panel inner fabric layer comprises:

a right compressive panel formed from the compression layer material extending from the first seam towards a centerline and from an upper portion of the torso portion to a bottom portion of the torso portion;

a left compressive panel formed from the compression layer material extending from the second seam towards the centerline and from the upper portion of the torso portion to the bottom portion of the torso portion; and lining material extending between the right compressive panel and the left compressive panel, wherein the lining material of the inner fabric layer of the back panel is coupled to the right compressive panel and the left compressive panel by a fifth seam and a sixth seam, respectively, and lacing extending across the centerline of the back panel configured to adjust a waist size, wherein the lacing is coupled to a plurality of points along a third seam and a fourth seam of the back panel, and wherein:

ends of the lacing are capable of being tied together at a location proximate to a waist region of a wearer, and the lacing extends across a u-shaped portion that is defined in the torso portion of the back panel, wherein:

the u-shaped portion extends across the centerline of the back panel, and the u-shaped portion has a wider width at a top portion of the u-shaped portion as compared to a bottom portion of the u-shaped portion; and wherein the compression layer material has a higher elastic modulus than a respective elastic modulus of the lining material of the front panel inner fabric layer and the back panel inner fabric layer, and wherein the compression layer material of the right compressive panel, the left compressive panel, and the compression layer of the front panel inner fabric layer are the same material.

8. The dress of claim 7, wherein:

the front panel inner fabric layer comprises lining material in each of a bottom portion and a pectoral portion of the front panel inner fabric layer.

9. The garment of claim 1, wherein the u-shaped portion is a u-shaped opening extending across the centerline of the lining material of the back panel.

10. The garment of claim 1, wherein the garment is configured to reduce a waistline of the wearer such that a natural waist to hip ratio of the wearer is decreased.

11. The garment of claim 1, wherein the compression layer material comprises nylon and spandex.

12. The garment of claim 1, wherein the third seam and the fourth seam of the back panel are connected such that the third seam and the fourth seam define a u-shaped seam of the u-shaped portion.

13. The garment of claim 1, wherein the garment is configured to put on and remove in one piece.

14. The garment of claim 1, wherein, as the wearer puts on the garment the back panel is configured to stretch and the lining material of the back panel is configured to contract to a form of the wearer while the left compressive panel and the right compressive panel conform to left and right sides of the wearer.

15. The dress of claim 7, wherein the dress is configured to reduce a waistline of the wearer such that a natural waist to hip ratio of the wearer is decreased.

16. The dress of claim 7, wherein the compression layer material comprises nylon and spandex.

17. The garment of claim 1, wherein, when in use, each of the fifth seam and the sixth seam are independently configured to extend past the waist region of the wearer when the garment is in use such that a bottom portion of each of the fifth seam and the sixth seam is configured to be located between the waist region of the wearer and a bottom opening of the garment.

18. The garment of claim 17, wherein, when in use, a top portion of each of the fifth seam and the sixth seam are configured to be proximate to a shoulder blade region of the wearer.

19. The garment of claim 1, wherein the outer fabric layer of the back panel is configured to cover the fifth seam and the sixth seam such that the fifth seam and sixth seam are not visible when covered by the outer fabric layer of the back panel.

* * * * *